US008383314B2

(12) United States Patent
Shoshi et al.

(10) Patent No.: US 8,383,314 B2
(45) Date of Patent: Feb. 26, 2013

(54) PHOTOCURABLE LIQUID DEVELOPER, METHOD FOR PRODUCING THE SAME, DEVELOPING DEVICE AND IMAGE FORMING APPARATUS

(75) Inventors: Masayuki Shoshi, Kanagawa (JP); Tsuneo Kurotori, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 189 days.

(21) Appl. No.: 12/970,231

(22) Filed: Dec. 16, 2010

(65) Prior Publication Data

US 2011/0183254 A1 Jul. 28, 2011

(30) Foreign Application Priority Data

Jan. 25, 2010 (JP) ..... 2010-013335

(51) Int. Cl.
*G03G 9/00* (2006.01)

(52) U.S. Cl. ..... 430/116; 430/112

(58) Field of Classification Search ..... 430/112, 430/116

See application file for complete search history.

(56) References Cited

U.S. PATENT DOCUMENTS 6,939,655 B2 * 9/2005 Tsubuko et al. ..... 430/124.5
2004/0010075 A1 1/2004 Tsubuko et al.

FOREIGN PATENT DOCUMENTS

EP 0 455 343 A1 11/1991
JP 2000-206738 7/2000

OTHER PUBLICATIONS

Extended European Search Report issued May 19, 2011, in Patent Application No. 10195222.4.

* cited by examiner

*Primary Examiner* — Stewart Fraser
(74) *Attorney, Agent, or Firm* — Oblon, Spivak, McClelland, Maier & Neustadt, L.L.P.

(57) ABSTRACT

To provide a photocurable liquid developer including colored resin particles, and an electrically insulating liquid that cures by light, wherein the electrically insulating liquid contains an unsaturated group-containing silicone compound represented by General Formula (1) below, General Formula (1)

where R independently denotes a methyl group or a phenyl group, l and m each independently denote an integer of 0 to 100, and $X_1$, $X_2$ and $X_3$ each independently denote a C1-C6 alkyl group or Substituent A below, with at least one of $X_1$, $X_2$ and $X_3$ being Substituent A, Substituent A where R denotes a methyl group or a phenyl group, and n denotes an integer of 2 or 3.

4 Claims, 2 Drawing Sheets

PHOTOCURABLE LIQUID DEVELOPER, METHOD FOR PRODUCING THE SAME, DEVELOPING DEVICE AND IMAGE FORMING APPARATUS

BACKGROUND OF THE INVENTION

1. Field of the Invention

The present invention relates to a photocurable liquid developer used in an image forming apparatus utilizing an electrophotographic method such as electrophotography, electrostatic recording or electrostatic printing, and a photocurable liquid developer used in an inkjet recording apparatus (hereinafter, these photocurable liquid developers will be referred to also as "liquid developers"); a method for producing a liquid developer; and a developing device and an image forming apparatus which use a liquid developer.

2. Description of the Related Art

The electrophotographic method is a method for obtaining printed matter by uniformly charging the surface of an image bearing member such as a photoconductor (a charging step), exposing the surface of the image bearing member so as to form a latent electrostatic image on the surface (an exposing step), developing the formed latent electrostatic image with a developer including colored resin particles (a developing step), transferring the developer image to a recording medium such as paper or OHP sheet (a transfer step), and fixing the transferred developer image to the recording medium (a fixing step). In this case, usable developers are broadly classified into dry developers in which colored resin particles formed of materials including binder resins and colorants such as pigments are used in a dried state, and liquid developers obtained by dispersing colored resin particles in electrically insulating liquids.

Nowadays, there is an increasing need for image colorization with respect to image forming apparatuses utilizing the electrophotographic method, such as copiers, facsimiles and printers. Color printing involves, for example, printing a high-resolution, high-quality image such as a photograph, for which reproduction of a vivid color tone is required; accordingly, a developer capable of meeting such requirements is demanded. Further, on the market, there is a new demand for increase in processing speeds (the term "processing speeds" refers to development processing speed, transfer processing speed and fixation processing speed), which does not cause decrease in image quality.

Dry developers, for which developers in a solid state are used, are popular among developers at present because of their advantageousness in terms of handleability. To obtain a high-resolution, high-quality image, a developer is required to have chargeability which is appropriate for attachment of the developer in an amount corresponding to the charge density of a latent electrostatic image formed on an image bearing member. However, the dry developers present problems with the environmental stability of their chargeability in terms of prevention of image degradation caused by environmental changes such as temperature change and humidity change; moreover, the dry developers easily cause aggregation of colored resin particles, for example while stored, and thus present problems with the uniformity, etc. of the colored resin particles when the colored resin particles are dispersed. Also regarding these properties, the above-mentioned problems, caused by the dry developers being in powder form, become more noticeable when the colored resin particles are made relatively small in particle diameter in an attempt to achieve high resolution.

Liquid developers, meanwhile, include electrically insulating liquids as carrier liquids; thus, they do not easily cause the problem of aggregation of colored resin particles therein while stored, in comparison with the dry developers, and therefore use of fine toners is possible. As a result, the liquid developers are superior to the dry developers in terms of reproducibility of images containing thin lines, tone reproducibility and color reproducibility, and can be superiorly employed in image forming methods involving high speed processing. Development of high-image-quality, high-speed digital printing apparatuses that utilize electrophotographic techniques using liquid developers, which takes advantage of the foregoing superior features, is becoming more and more active. Under these circumstances, development of liquid developers with better properties is demanded.

Examples of known conventional liquid developers include a developer obtained by dispersing colored resin particles in an electrically insulating liquid such as silicone oil. However, such a liquid developer hinders bonding of colored resin particles at the time of image fixation owing to the presence of the electrically insulating liquid, and thus the developer may not be favorably fixed to a recording medium. Accordingly, it is necessary to remove the electrically insulating liquid using a plurality of removal rollers before image fixation, which causes an image forming apparatus with the liquid developer to be complex and makes it difficult to meet the demand for high-speed processing.

As a countermeasure against the foregoing problems, there has been proposed a method of curing an electrically insulating liquid. For example, Japanese Patent Application Laid-Open (JP-A) No. 2007-525717 proposes a method of fixing colored resin particles by cross-linking a silicone oil serving as an electrically insulating liquid. However, this proposed method utilizes an oxidation reaction, a hydrosilylation reaction, a condensation reaction, etc., so that there is a limitation to the reaction rate and it is therefore difficult to meet the demand for high-speed processing.

Further, there has been proposed a method of curing an electrically insulating liquid by photopolymerization. A photocurable liquid developer in this case includes reactive functional group-containing monomer(s)/oligomer(s) as an electrically insulating liquid, and a photopolymerization initiator is added and dissolved in the electrically insulating liquid. By irradiating this photocurable liquid developer with light, e.g., ultraviolet rays, the developer cures due to a polymerization reaction, thereby making it possible to adapt to high-speed processing. Examples of such a photocurable liquid developer include the one described in Japanese Patent (JP-B) No. 3442406. In JP-B No. 3442406, a curable liquid vehicle with a specific viscosity range and a specific resistance value range is disclosed as a curable electrically insulating liquid, and the curable liquid vehicle is exemplified by a (meth)acrylic-modified silicone. More specifically, there is a description saying that a silicone portion contains an aliphatic/aromatic siloxane chain or ring with a specific dimethylsiloxane unit.

Meanwhile, JP-B No. 4150118 discloses inclusion of a reactive silicone compound in a curable electrically insulating liquid, and examples of the reactive silicone compound include silicone compounds having, in their molecules, functional groups such as isocyanate group, Si—H group, vinyl group, amino group, hydroxyl group, epoxy group, methacryloxy group, etc.

However, the (meth)acrylic-modified silicones described in JP-B Nos. 3442406 and 4150118 are highly photocurable but present a serious problem in terms of safety. Vinyl monomers such as styrene monomers and (meth)acrylic monomers generally have strong reactivity, are potentially dangerous, may irritate the skin or eyes, may become hypersensitivity-inducing substances (sensitizing substances), possibly induce allergy and have strong, unpleasant smells; as a result of all this, the uses of the vinyl monomers are restricted or the vinyl monomers are prohibited from being used. Moreover, the vinyl group-containing silicone compound exemplifying the reactive silicone compound, mentioned in JP-B No. 4150118, does not sufficiently cure by ultraviolet irradiation and is therefore problematic in terms of fixability.

BRIEF SUMMARY OF THE INVENTION

The present invention provides a photocurable liquid developer which is highly safe, reduces the occurrence of background smears and image blurring and has sufficient fixability; a method for producing a photocurable liquid developer; and a developing device and an image forming apparatus which use the photocurable liquid developer.

The present inventors have taken note of the fact that an electrically insulating liquid which contains an unsaturated group-containing silicone compound represented by General Formula (1) below is chemically highly stable and excellent in safety compared to a silicone compound having a functional group (e.g., methacryloxy group) in its molecule, and examined use of a photocurable liquid developer which includes this electrically insulating liquid and colored resin particles.

General Formula (1)

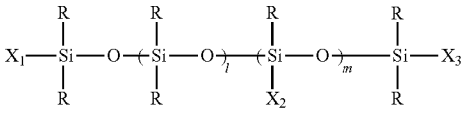

In General Formula (1), R independently denotes a methyl group or a phenyl group, l and m each independently denote an integer of 0 to 100, and $X_1$, $X_2$ and $X_3$ each independently denote a C1-C6 alkyl group or Substituent A below, with at least one of $X_1$, $X_2$ and $X_3$ being Substituent A.

Substituent A

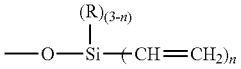

In Substituent A above, R denotes a methyl group or a phenyl group, and n denotes an integer of 2 or 3.

As a result, the present inventors have found that by applying light to the photocurable liquid developer including the electrically insulating liquid, it is possible to fix the electrically insulating liquid as well as the colored resin particles to a recording medium due to radical polymerization, and thus to increase the processing speed of an image forming apparatus and reduce energy consumption, without necessitating thermal melting and fixing of a toner as in a conventional method.

Although the reason why the electrically insulating liquid which contains the unsaturated group-containing silicone compound exhibits superior curability, despite being chemically highly stable compared to a silicone compound having a functional group (e.g., methacryloxy group) in its molecule, is not clear, it is inferred that the superior curability can be realized because the polymerization of the unsaturated group-containing silicone compound is not merely radical polymerization but a concerted reaction (e.g., Diels-Alder reaction) of a plurality of vinyl groups bonded to an Si atom.

Also, the colored resin particles are enabled to yield superior dispersibility and redispersibility and form higher-quality images, by bringing about a reaction preferably between colored resin particles, which have an acidic group at surfaces thereof, and at least one of an epoxy group-modified silicone compound and an epoxy group-containing long-chain alkyl compound, such that the silicone group is directly bonded to and cover the surfaces of the colored resin particles. Further, since at least one of the silicone group and the epoxy group-containing long-chain alkyl group is directly bonded to and cover the surfaces of the colored resin particles, it is possible to form higher-quality images by minimizing effects on the properties of the liquid developer, such as resistance, with at least one of a small amount of the epoxy group-modified silicone compound and the epoxy group-containing long-chain alkyl compound. Also, the present inventors have found that by producing colored resin particles having an acidic group at surfaces thereof in accordance with a polymerization method, the particles are homogeneously produced, more uniform charging properties can be secured, and thus higher-quality images can be formed.

Also, the present inventors have found that the photocurable liquid developer according to the present invention can be produced by a very simple method wherein a reaction is brought about under moderate conditions between colored resin particles, which have an acidic group at surfaces thereof, and at least one of an epoxy group-modified silicone compound and an epoxy group-containing long-chain alkyl compound, in an electrically insulating liquid that contains an unsaturated group-containing silicone compound.

The present invention is based upon the findings of the present inventors, and means for solving the problems are as follows.

<1> A photocurable liquid developer including: colored resin particles; and an electrically insulating liquid that cures by light, wherein the electrically insulating liquid contains an unsaturated group-containing silicone compound represented by General Formula (1) below, General Formula (1)

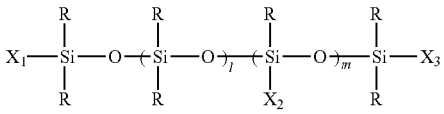

where R independently denotes a methyl group or a phenyl group, l and m each independently denote an integer of 0 to 100, and $X_1$, $X_2$ and $X_3$ each independently denote a C1-C6 alkyl group or Substituent A below, with at least one of $X_1$, $X_2$ and $X_3$ being Substituent A, Substituent A

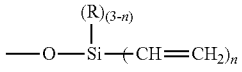

where R denotes a methyl group or a phenyl group, and n denotes an integer of 2 or 3.

<2> The photocurable liquid developer according to <1>, wherein the unsaturated group-containing silicone compound is a compound represented by General Formula (2) below, General Formula (2)

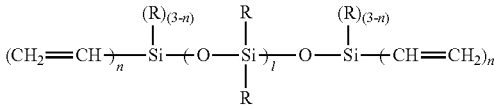

where R independently denotes a methyl group or a phenyl group, l denotes an integer of 0 to 100, and n denotes an integer of 2 or 3.

<3> The photocurable liquid developer according to <1> or <2>, further including a photopolymerization initiator.

<4> The photocurable liquid developer according to any one of <1> to <3>, wherein the colored resin particles contain at least a binder resin and a colorant and have an acidic group at surfaces thereof, and wherein the colored resin particles are chemically modified with at least one of an epoxy group-modified silicone compound and an epoxy group-containing long-chain alkyl compound, as the epoxy group reacts with the acidic group.

<5> A method for producing a photocurable liquid developer which includes colored resin particles and an electrically insulating liquid that cures by light, the method including: dispersing the colored resin particles, which contain at least a binder resin and a colorant and have an acidic group at surfaces thereof, into a photocurable electrically insulating liquid, which contains at least one of an epoxy group-modified silicone compound and an epoxy group-containing long-chain alkyl compound and is provided with ultrasonic vibration, such that the surfaces of the colored resin particles are chemically modified with at least one of the epoxy group-modified silicone compound and the epoxy group-containing long-chain alkyl compound, as the epoxy group reacts with the acidic group.

<6> The method according to <5>, wherein the colored resin particles having the acidic group at the surfaces thereof are produced by a polymerization method.

<7> The method according to <5>, wherein the colored resin particles having the acidic group at the surfaces thereof are produced by depositing an acidic group-containing resin, which has been neutralized and dissolved in an aqueous solvent, on a surface of the colorant in the aqueous solvent in accordance with a salting-out method.

<8> A developing device including: a developer accommodating portion which accommodates a photocurable liquid developer; and a developer supply unit configured to draw the photocurable liquid developer from the developer accommodating portion and supply the photocurable liquid developer to a latent electrostatic image formed on an image bearing member, wherein the photocurable liquid developer is the photocurable liquid developer according to any one of <1> to <4>.

<9> An image forming apparatus including: an image bearing member on which a latent electrostatic image is formed; a developing device configured to supply a photocurable liquid developer to the latent electrostatic image formed on the image bearing member, so as to develop the latent electrostatic image into a liquid developer image; a transfer device configured to transfer the liquid developer image formed by the developing device from the image bearing member to a recording medium; and a fixing device configured to cure the photocurable liquid developer by application of light to the liquid developer image transferred by the transfer device, so as to fix the liquid developer image on the recording medium, wherein the photocurable liquid developer is the photocurable liquid developer according to any one of <1> to <4>.

The present invention makes it possible to provide a photocurable liquid developer which is highly safe, reduces the occurrence of background smears and image blurring and has sufficient fixability, by inclusion of an unsaturated group-containing silicone compound (represented by General Formula (1) above) in an electrically insulating liquid; a method for producing a photocurable liquid developer; and a developing device and an image forming apparatus which use the photocurable liquid developer.

Figure 1:
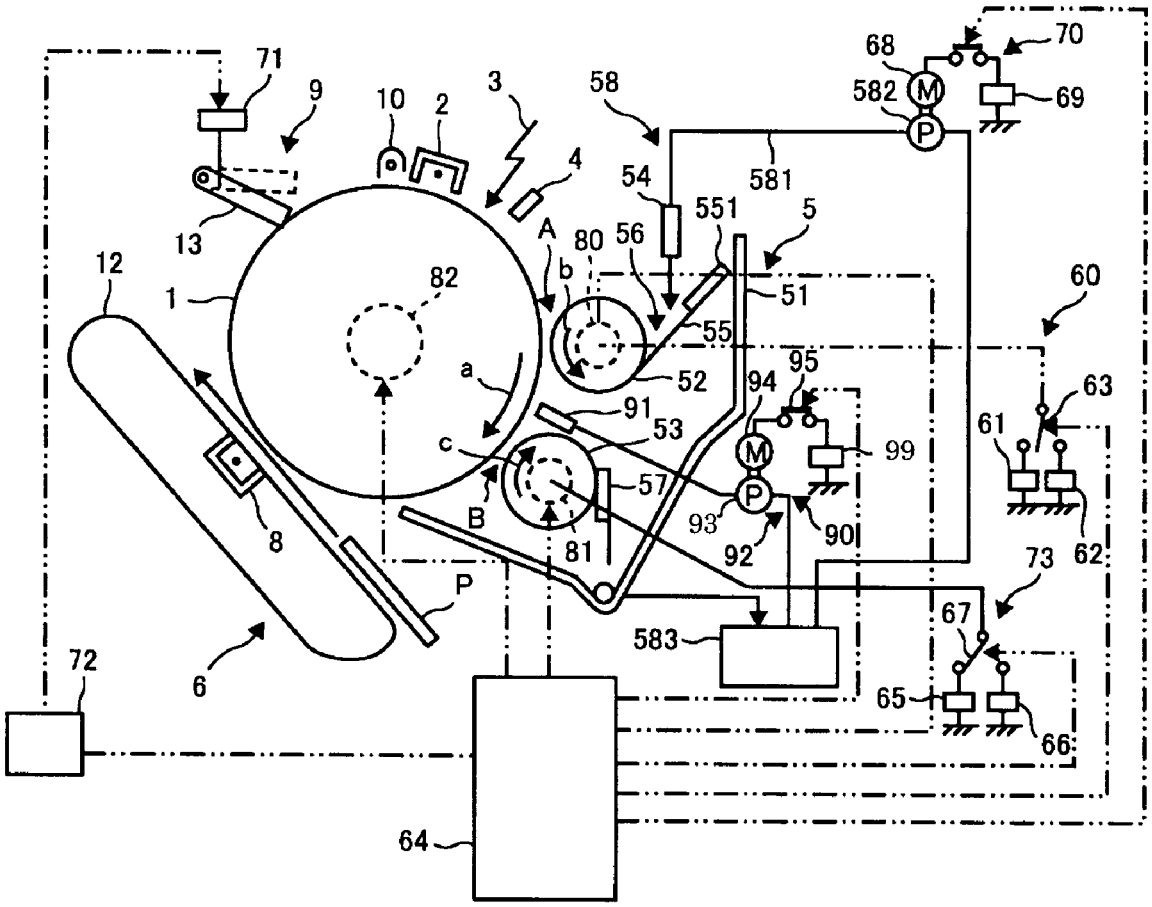
FIG. 1 is a drawing schematically showing the structure of an electrophotographic image forming apparatus according to an embodiment of the present invention.

DETAILED DESCRIPTION OF THE INVENTION (Photocurable Liquid Developer)

A photocurable liquid developer of the present invention includes colored resin particles, and an electrically insulating liquid that cures by light. If necessary, the photocurable liquid developer may further include other components.

<Colored Resin Particles>

Here, a production method of the colored resin particles, which have an acidic group at surfaces thereof, is explained.

First of all, a method of introducing the acidic group to the surfaces of the colored resin particles is explained.

The method of introducing the acidic group may be suitably selected from conventionally known methods. For example, a granulation method utilizing the difference in solubility relative to an acidic group-containing resin, or more specifically, a method of dissolving an acidic group-containing resin in a solvent and adding the obtained solution dropwise to the acidic group-containing resin in a poor solvent is suitable; in particular, a method of dissolving an acidic group-containing resin in a solvent and performing granulation in an aqueous continuous phase is suitable in that the acidic group as a polar group is peculiarly formed at particle surfaces. In this case, an auxiliary agent such as a dispersion stabilizer may, if necessary, be added into the aqueous continuous phase (coacervation method). Note that a colorant and, if necessary, additives such as a dispersant, a thermal stabilizer, an antioxidant and an ultraviolet absorber may be uniformly dissolved or dispersed in the resin or in a dispersion liquid containing the resin.

At a predetermined temperature, the colorant is dispersed in a solution in which the acidic group-containing resin is made soluble in an aqueous solvent by neutralization. In the obtained dispersion liquid, the colorant is stably dispersed in the aqueous medium by the action of an electrical double layer formed by a salt of the acidic group. Next, regarding a method (salting-out method) in which an electrolyte that destroys or diminishes the electrical double layer is added to the dispersion liquid so as to make the neutralized resin unstable and thus to deposit colored resin particles, this method involves deposition of the resin based upon the resin aqueous solution and therefore makes it possible to obtain very uniform and homogeneous colored resin particles, and further, this method can be suitably used because it is a simple production method which does not necessitate using a dispersant or dispersion stabilizer and can therefore be free of attachment of a dispersant or dispersion stabilizer to the colored resin particles. Examples of the electrolyte include acidic substances such as hydrochloric acid, sulfuric acid, phosphoric acid, acetic acid and oxalic acid; organic or inorganic water-soluble salts such as sodium sulfate, ammonium sulfate, potassium sulfate, magnesium sulfate, sodium phosphate, sodium chloride, potassium chloride and sodium acetate. These electrolytes may be used individually or in combination. Among these, monocationic sulfates such as sodium sulfate, ammonium sulfate and potassium sulfate are particularly preferable in terms of uniform deposition of the colored resin particles.

Examples of the resin include synthetic resins such as acrylic resins, styrene resins, epoxy resins, urethane resins, vinyl resins, phenol resins, polyester resins, polyamide resins and melamine resins; natural resins such as gelatin, casein and cellulose starch; copolymer resins, etc. which are based upon the above resins and to which acidic groups (e.g., carboxyl group and sulfonic acid group) or salts thereof have been introduced. Also, these resins may have cross-linked structures depending upon the purpose of the use. It is preferred that the acidic group-containing resin be used such that its acid value lies in the range of 3 mgKOH/g to 300 mgKOH/g.

Further, the method of introducing the acidic group to the surfaces of the particles may be a polymerization method. The polymerization method includes preparing a polymerizable composition by uniformly dissolving or dispersing a polymerization initiator and, if necessary, additives such as a colorant and a cross-linking agent into polymerizable monomer(s) or polymerization precursor(s) (e.g., oligomer(s)) or into a dispersion liquid medium in which the polymerizable monomer(s) or the polymerization precursor(s) is/are dispersed; and then increasing the temperature so as to effect polymerization. Thus, it is possible to obtain particles having a desired particle diameter. Additionally, additives such as a chain transfer agent, a wax and a charge controlling agent may, if necessary, be added. The polymerization method makes it possible to obtain particles with a narrow particle size distribution in comparison with particles obtained by the coacervation method and is therefore suitable for uses which require further uniformity of particles.

Since the particle size distribution of the particles is reflected in the particle size distribution of the colored resin particles to be produced in the present invention, it is preferred that the particles have high monodispersity and the relative standard deviation (CV value) of the particle diameters be 30% or less. When the relative standard deviation (CV value) is more than 30%, the particle size distribution of the electrostatic charge developing colored resin particles produced from the above-mentioned particles widens, and the properties of the particles produced may be considerably impaired owing to the nonuniformity of the particle diameters, thereby possibly causing a problem, for example variation in electrostatic properties such as chargeability.

The relative standard deviation (CV value) is calculated according to Formula (1) below.

$$\text{Relative standard deviation}(CV\ \text{value}(\%))=(sd/m)\times 100 \qquad \text{Formula (1)}$$

(In Formula (1) above, sd denotes the standard deviation of the particle diameters, and m denotes the average particle diameter.)

Here, the symbols sd and m are values obtained by a dynamic light scattering method using a particle size analyzer (FPAR-1000, manufactured by Otsuka Electronics Co., Ltd.).

The polymerization method by which to obtain the colored resin particles having the acidic group may be suitably selected from dispersion polymerization, suspension and emulsion polymerization. The colored resin particles having the acidic group at the surfaces thereof are preferably produced by polymerization in an aqueous medium; colored resin particles having an average particle diameter of 0.3 μm to 5 μm are particularly preferably produced by dispersion polymerization in an aqueous medium, and colored resin particles having an average particle diameter of 0.01 μm to 0.3 μm are particularly preferably produced by emulsion polymerization.

The term "aqueous medium" means an aqueous solution containing a hydrophilic organic solvent. The term "hydrophilic organic solvent" means an organic solvent whose solubility in water at 20° C. is 2% or more.

Examples of the hydrophilic organic solvent include alcohols such as methyl alcohol, ethyl alcohol, modified ethyl alcohol, isopropyl alcohol, n-butyl alcohol, isobutyl alcohol, tert-butyl alcohol, sec-butyl alcohol, tert-amyl alcohol, 3-pentanol, benzyl alcohol, cyclohexanol, ethylene glycol, glycerin and diethylene glycol; ether alcohols such as methyl cellosolve, ethyl cellosolve, isopropyl cellosolve, butyl cellosolve, diethylene glycol monomethyl ether and diethylene glycol monoethyl ether; ethers such as tetrahydrofuran, ethylene glycol dimethyl ether and dioxane; and nitrogen atom-containing organic solvents such as pyridine and dimethylformamide. These hydrophilic organic solvents may be used individually or in combination. Preferable among these are lower alcohols such as methyl alcohol, ethyl alcohol and isopropyl alcohol.

With a mixed solvent composed of water and any of these hydrophilic organic solvents, it is possible to control the particle diameter and the particle size distribution, maintaining polymerization stability. The mixture ratio of the hydrophilic organic solvent to water at the time of preparation of the aqueous medium is preferably in the range of 99:1 to 5:95 as a mass ratio. When the ratio of the hydrophilic organic solvent is more than 99% by mass, there may be cohesion of the polymer produced. When the ratio of the hydrophilic organic solvent is less than 5% by mass, there may be a decrease in dispersion stability, which possibly makes it impossible to control the particle diameter and the particle size distribution.

Also, to control the particle diameter, the particle size distribution and the dispersion stability, an organic solvent other than the hydrophilic organic solvent may be used in combination with the hydrophilic organic solvent to such an extent that the produced polymer does not dissolve therein. Examples of the organic solvent include hydrocarbons such as hexane, octane, decane, hexadecane, cyclohexane, petroleum ether, toluene and xylene; halogenated hydrocarbons such carbon tetrachloride, trichloroethylene and tetrabromoethane; ketones such as acetone, methyl ethyl ketone, methyl isobutyl ketone and cyclohexanone; and esters such as ethyl acetate and butyl acetate. Further, the polymerization may be performed in the presence of inorganic ions such as $SO_4^{2-}$, $PO_4^{3-}$, $Cl^-$, $Na^+$, $K^+$, $Mg^{2+}$, $Ca^{2+}$, etc. or with the pH of the aqueous medium adjusted.

Next, in the case where dispersion polymerization in the aqueous medium is employed, specifically, predetermined polymerizable monomer(s), a colorant and a polymerization initiator are sequentially added to the aqueous medium and dispersed, and heating is carried out such that polymerization proceeds. A plurality of polymerizable monomers may be separately added or may be mixed together beforehand and thus added. Also, the polymerizable monomer(s) may be directly added or may be mixed with water, a surfactant, etc.

beforehand and added as an emulsified liquid. The polymerization temperature and the polymerization time may be suitably set according to the intended purpose, provided that a polymerization reaction takes place.

Radical polymerizable monomer(s), which are component(s) necessary for the polymerization, is/are not particularly limited and may be suitably selected according to the intended purpose.

Examples thereof include styrene derivatives such as styrene, α-methylstyrene, p-methylstyrene, p-chlorostyrene and chloromethylstyrene; vinyl esters such as vinyl chloride, vinyl acetate and vinyl propionate; unsaturated nitriles such as acrylonitrile; (meth)acrylic acid ester derivatives such as methyl (meth)acrylate, ethyl (meth)acrylate, butyl (meth) acrylate, 2-ethylhexyl (meth)acrylate, stearyl (meth)acrylate, ethylene glycol (meth)acrylate, trifluoroethyl (meth)acrylate, pentafluoropropyl (meth)acrylate, cyclohexyl (meth)acrylate, dimethylaminoethyl (meth)acrylate and diethylaminoethyl (meth)acrylate; (meth)acrylamide derivatives such as N,N-dimethyl(meth)acrylamide, N-dimethylaminoethyl (meth)acrylamide and N-dimethylaminopropyl(meth)acrylamide; and vinylpyridine derivatives such as 4-vinylpyridine.

Among these, amino group-containing monomers or salts thereof, such as dimethylaminoethyl (meth)acrylate, diethylaminoethyl (meth)acrylate, N,N-dimethyl(meth)acrylamide, N-dimethylaminoethyl(meth)acrylamide, N-dimethylaminopropyl(meth)acrylamide and 4-vinylpyridine, are important as monomers having charge controlling ability in production of electrostatic charge developers with positive chargeability. Also, a method of controlling chargeability by means of monomer(s) is superior to a method of controlling chargeability by means of a charge controlling agent (described later) in terms of charging stability because the former method has smaller effects on the electrical resistance of an electrostatic charge developer.

Examples of the acidic group, which is a necessary component used in the production of the desired particles, include a carboxyl group, a sulfonic acid group, an aromatic hydroxy group and a methylol group (acidic groups which do not contain active hydrogen groups, for example a nitro group, a nitroso group and an acid anhydride group, are not relevant to the term "acidic group" in the present invention), with preference being given to a carboxyl group and a sulfonic acid group. Examples of monomers containing such acidic groups include styrene compounds such as 4-vinylbenzoic acid, 3-vinylbenzoic acid and 4-styrenesulfonic acid; and (meth) acrylic acid compounds such as (meth)acrylic acid, itaconic acid, itaconic acid monobutyl ester, maleic acid, maleic acid monomethyl ester, maleic acid monobutyl ester, 2-carboxyethyl (meth)acrylate, succinic acid mono(2-acryloyloxyethyl)ester, 2-acrylamide-2-methylpropanesulfonic acid and 2-(methacryloyloxy)ethylsulfonic acid. Note that the terms "(meth)acrylic acid" and "(meth)acrylate" in the present invention refer to "acrylic acid and methacrylic acid" and "acrylate and methacrylate" respectively. The amount of the acidic group-containing monomer(s) used is preferably in the range of 1 part by mass to 30 parts by mass per 100 parts by mass of all the monomers, i.e. a combination of the acidic group-containing monomer(s) and the radical polymerizable monomer(s).

The acid value of the colored resin particles produced is preferably in the range of 3 mgKOH/g to 200 mgKOH/g. When the acid value is less than 3 mgKOH/g, there is a limitation on a reaction in relation to chemical modification with an epoxy group-modified silicone compound and/or an epoxy group-containing long-chain alkyl compound in a subsequent step, so that the functions of the silicone group and/or the long-chain alkyl group at the surfaces of the colored resin particles are not sufficiently performed and favorable dispersibility and dispersion stability cannot be obtained. When the acid value is greater than 200 mgKOH/g, properties can hardly be improved, and the functions of the silicone group and/or the long-chain alkyl group at the surfaces of the colored resin particles are deemed to reach saturation point. When the acid value is in the range of 3 mgKOH/g to 200 mgKOH/g, there is an improvement in dispersion stability at the time of the production of particles, the amount of a dispersant or a dispersion stabilizer can be reduced (self dispersion), particles with high monodispersity can be produced as a result, and further, environmental and operational advantages can be yielded, for example a reduction in the number of times washing is carried out. Therefore, the acidic group-containing monomer(s) is/are preferably used such that its/their acid value(s) range(s) between 3 mgKOH/g and 200 mgKOH/g.

The above monomers may be used individually or in combination. Also, if necessary, cross-linkable monomer(s) containing two or more vinyl groups per monomer unit may be used. The cross-linkable monomer(s) containing two or more vinyl groups per monomer unit is/are not particularly limited and may be suitably selected according to the intended purpose; examples thereof include divinylbenzene, divinylbiphenyl, divinylnaphthalene, ethylene glycol di(meth)acrylate, butadiene glycol di(meth)acrylate and polyethylene glycol di(meth)acrylate. These cross-linkable monomers may be used individually or in combination.

A chain transfer agent may be added to the polymerizable composition in order to control the degree of polymerization of the resin and adjust properties (e.g., softening point and molecular weight). The chain transfer agent is not particularly limited, and a chain transfer agent generally used in radical polymerization reaction may, for example, be used. Specific examples of the chain transfer agent include mercaptans such as octylmercaptan, dodecylmercaptan and tert-dodecylmercaptan, and styrene dimers.

Here, a radical polymerization initiator used for the production of the particles having the acidic group at the surfaces thereof is explained.

The radical polymerization initiator is not particularly limited and may be suitably selected according to the intended purpose. Examples thereof include persulfates such as potassium persulfate and ammonium persulfate; peroxides such as benzoyl peroxide, lauroyl peroxide, oxochloro benzoyl peroxide, t-butylperoxy-2-ethylhexanoate and di-t-butyl peroxide; and azo compounds such as 2,2'-azobisisobutyronitrile, 2,2'-azobis(2-methylbutyronitrile), 1,1'-azobis(cyclohexane-1-carbonitrile), 2,2'-azobis(2,4-dimethylvaleronitrile), 2,2'-azobis[2-methyl-N-(2-hydroxyethyl)propionamide], dimethyl 2,2'-azobisisobutylate, 2,2'-azobis(2-methylpropionamidine) salt, 2,2'-azobis[N-(2-carboxyethyl)-2-methylpropionamidine] and 4,4'-azobis(4'-cyanovaleric acid). Preferable among these are azo oil-soluble polymerization initiators such as 2,2'-azobisisobutyronitrile, 2,2'-azobis(2-methylbutyronitrile), 1,1'-azobis(cyclohexane-1-carbonitrile) and 2,2'-azobis(2,4-dimethylvaleronitrile).

The radical polymerization initiator may, if necessary, be used as a redox initiator that includes a reducing agent. It is expected that use of a redox initiator makes it possible to increase polymerization activity, lower the polymerization temperature and shorten the polymerization time. Also, the amount of the radical polymerization initiator used is preferably in the range of 0.1 parts by mass to 10 parts by mass per 100 parts by mass of the polymerizable monomer(s).

Next, additives optionally used for the production of the particles having the acidic group at the surfaces thereof will be explained.

In producing the particles having the acidic group at the surfaces thereof, a surfactant may, if necessary, be added. The amount of the surfactant is preferably in the range of 0.1 parts by mass to 5 parts by mass per 100 parts by mass of all the monomers. The surfactant is not particularly limited and may be suitably selected according to the intended purpose, and any of the ionic surfactants and the nonionic surfactants mentioned below can be suitably used.

Examples of the ionic surfactants include sulfonates such as sodium dodecylbenzenesulfonate, sodium arylalkylpolyethersulfonate and 3,3-disulfonediphenylurea-4,4-diazobis-amino-8-naphthol-6-sodium sulfonate; sulfuric acid esters such as sodium dodecyl sulfate, sodium tetradecyl sulfate, sodium pentadecyl sulfate and sodium dialkylsulfosuccinate; and fatty acid salts such as sodium oleate, sodium laurate, sodium caprate, sodium caproate and potassium stearate.

Examples of the nonionic surfactants include polyethylene oxide, polypropylene oxide, a combination of polyethylene oxide and polypropylene oxide, higher fatty acid esters of polyethylene glycol, higher fatty acid esters of polypropylene oxide, alkylphenol polyethylene oxides, alkylphenol polypropylene oxides, polyethylene oxide alkyl ethers, polypropylene oxide alkyl ether glycols and sorbitan esters.

Further, a dispersion stabilizer may, if necessary, be added. Examples of the dispersion stabilizer include polymeric dispersion stabilizers such as partially saponified polyvinyl alcohol, poly(meth)acrylic acid, polystyrene-poly(meth)acrylic acid copolymer, poly(meth)acrylic acid-poly(meth)acrylic acid ester copolymer, polyvinylpyrrolidone, polyvinyl ethers, gelatin, methyl cellulose, ethyl cellulose, hydroxyethyl cellulose, and sodium salts of carboxymethyl cellulose; and inorganic dispersion stabilizers such as calcium phosphate, magnesium phosphate, aluminum phosphate, calcium carbonate, magnesium carbonate, barium sulfate, magnesium hydroxide and bentonite.

Further, as a method of utilizing a dispersion stabilizing effect produced by grafting, macromonomer(s) may be used together with the above monomers. The macromonomer(s) is/are not particularly limited and may be suitably selected from known compounds, with preference being given to macromonomers having acidic groups such as carboxyl group and sulfonic acid group in their molecules. Any of these acidic group-containing macromonomers not only yields a dispersion stabilizing effect but also can be effectively used for part or the whole of the acidic group at the surfaces of the colored resin particles. These acidic group-containing macromonomer compounds are already commercially available on the market, and commercially available products may be used. For example, as (meth)acrylic acid/(meth)acrylic acid ester macromonomers, UM-9001, XM-9053, XM-9054 (all manufactured by TOAGOSEI CO., LTD.) and the like can be suitably used. The amount of the dispersion stabilizer used is preferably in the range of 0.1 parts by mass to 10 parts by mass per 100 parts by mass of all the monomers.

The above surfactants and the above dispersion stabilizers may be used with their pH values adjusted if necessary. For the pH adjustment, use of a weakly basic or weakly acidic compound is preferable. By means of such treatment, the surfactant or the dispersion stabilizer can have a hydrophilic functional group with a salt structure, and thus a dispersing function or a dispersion stabilizing function can be effectively yielded.

Besides the above components, a colorant is added. A colorant fine particle dispersion liquid can be prepared by dissolving or dispersing a colorant into an aqueous medium or a solvent medium. For the dispersion of the colorant, a surfactant or a dispersion stabilizer may be used in the case where it takes place in water; the surfactant and the dispersion stabilizer may be used individually or mixed in appropriate proportions. As for the solvent medium, a solvent which yields sufficient wetness with the colorant is selected, and a surfactant or a dispersion stabilizer may, if necessary, be used.

Examples of the solvent include methanol, ethanol, isopropanol, acetone, methyl ethyl ketone, methyl isobutyl ketone and tetrahydrofuran.

A dispersing machine used to disperse the colorant is not particularly limited and may be suitably selected according to the intended purpose. Suitable examples thereof include ultrasonic dispersing machines, pressurizing dispersing machines such as pressure-type homogenizers and mechanical homogenizers, and medium-type dispersing machines such as diamond fine mills, bead mills and sand grinders.

Examples of the colorant include pigments and dyes.

Regarding organic pigments, any conventionally known organic pigment may be used. Preferred examples of organic pigments include aniline blue, calco oil blue, chrome yellow, ultramarine blue, DuPont Oil Red, quinoline yellow, methylene blue chloride, copper phthalocyanine, malachite green oxalate, lamp black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Yellow 180, C.I. Pigment Yellow 185, C.I. Pigment Blue 15:1 and C.I. Pigment Blue 15:3.

Regarding inorganic pigments, any conventionally known inorganic pigment may be used. Preferred examples of inorganic pigments include carbon black, titanium oxide, red iron oxide, ferrite and magnetite.

These colorants may be used individually or in combination according to the desire.

Also, a so-called treated colorant (colored resin particles) obtained by covering any of these colorants with a resin may be used. Specifically, commercially available treated colorants such as Color Chips obtained by kneading a colorant and a resin with heating using a two roll mill or the like (manufactured by TAIHEI CHEMICALS LIMITED, Taisei Kako Co., Ltd., etc.) and MICROLITH (manufactured by Ciba Specialty Chemicals plc) may, for example, be used. Also, as the treated colorant, one obtained by any known method may be used, for example by a coacervation method in which a colorant is dispersed in a resin solution, and a poor solvent is added so as to deposit the resin on the surface of the colorant.

The amount of the colorant contained in the colored resin particles (including the colored resin particles having the acidic group at the surfaces thereof) is preferably in the range of 2 parts by mass to 50 parts by mass, more preferably 5 parts by mass to 30 parts by mass, per 100 parts by mass of the resin content.

The colored resin particles (including the colored resin particles having the acidic group at the surfaces thereof) are preferably resin particles with a uniform particle size distribution, with the volume average particle diameter thereof being preferably in the range of 0.3 μm to 5 μm. Also, the glass transition temperature (Tg) of the colored resin particles (including the colored resin particles having the acidic group at the surfaces thereof) is not particularly limited but is preferably in the range of −10° C. to 120° C. Also, the molecular weight of the colored resin particles is not particularly limited and may be suitably selected according to the intended purpose, with the weight average molecular weight thereof being preferably in the range of 2,000 to 1,000,000.

The method for producing the acidic group-containing colored resin particles is not particularly limited and may be suitably selected according to the intended purpose, and conditions for the production may be set according to the colorant used, the resin (or polymerizable monomer(s)) used, the dispersant (or dispersion stabilizer) used, etc. For example, in the case of dispersion polymerization in an aqueous medium, the colorant and the polymerizable monomer(s) are suitably added to an aqueous medium to which a dispersant or dispersion stabilizer may, if necessary, be added, the colorant and the polymerizable monomer(s) are uniformly dissolved or dispersed using a dispersing machine such as a homogenizer, ball mill, colloid mill or ultrasonic dispersing machine, a polymerization initiator is added, the temperature is increased to an appropriate temperature in the presence of a nitrogen stream, and a polyreaction is thus effected. As for the timing of the addition of the polymerization initiator, it may be added into the polymerizable monomer(s) or into the aqueous medium before or after the dissolution or dispersion. By filtering, washing and drying acidic group-containing particles in accordance with a known method, after the polymerization has finished and then the temperature has been lowered to room temperature, it is possible to produce acidic group-containing particles which include the colorant (acidic group-containing colored resin particles).

Next, a method for producing preferred colored resin particles will be explained.

Preferred colored resin particles, used for example as toner particles, are obtained by chemically modifying colored resin particles having an acidic group at surfaces thereof, as in the above description, with at least one of an epoxy group-modified silicone compound and an epoxy group-containing long-chain alkyl compound. The chemical modification is primarily effected by a chemical reaction between the epoxy group and the acidic group at the surfaces of the colored resin particles; it should be noted that by directly bonding the silicone group and/or the long-chain alkyl group to the surfaces of the colored resin particles via an ester group, the silicone group and/or the long-chain alkyl group cover(s) the colored resin particles, and thus it is possible to achieve favorable dispersibility, favorable redispersibility and long-term dispersion stability of the colored resin particles, without causing aggregation, fusion, etc. of the colored resin particles.

Generally, the colored resin particles can be produced by treatment of an epoxy-modified silicone and colored resin particles having an acidic group at surfaces thereof in an organic solvent. The organic solvent used may be any organic solvent as long as it does not dissolve the colored resin particles having the acidic group and can dissolve or partially dissolve an epoxy group-modified silicone compound and/or an epoxy group-containing long-chain alkyl compound. A reaction inactive organic solvent such as silicone oil, or a hydrocarbon can be favorably used.

The epoxy group-modified silicone compound and/or the epoxy group-containing long-chain alkyl compound have/has the molecular structure represented by General Formula (3) below. It is desirable that the siloxyl group denoted by the symbol $R_{13}$ have a structure including a dimethylpolysiloxane backbone, preferably including a C1-C6 lower alkyl group as a terminal substituent. The number of dimethylsiloxane units (degree of polymerization) is preferably in the range of 1 to 50, more preferably 1 to 16.

General Formula (3)

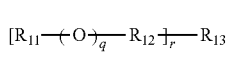

In General Formula (3), $R_{11}$ denotes an epoxy group such as epoxy group, glycidyl group or epoxycyclohexane group, q denotes an integer of 0 or 1, $R_{12}$ denotes a straight-chain or branched alkylene (methylene, ethylene, propylene, butylene, etc.) linking group, $R_{13}$ denotes a straight-chain or branched siloxyl group, a straight-chain or branched long-chain alkyl group, or a straight-chain or branched long-chain alkylcarbonyl group. In this case, the number (r) of substituents for the siloxyl group, the long-chain alkyl group or the long-chain alkylcarbonyl group can be 1 (r=1), 2 (r=2), 3 (r=3) or 4 (r=4); the number of substituents is not particularly limited but is preferably 1 (r=1).

The epoxy group-modified silicone compound is already commercially available, and a commercially available product may be used. Suitable specific examples thereof include low-molecular-weight epoxy-modified silicones such as (3-glycidoxypropyl)bis(trimethylsiloxy)methylsilane (manufactured by AZmax. co) and (3-glycidoxypropyl)pentamethyldisiloxane (manufactured by AZmax. co); and high-molecular-weight epoxy-modified silicones such as MCR-E11 (manufactured by AZmax. co), MCR-E21 (manufactured by AZmax. co), X-22-173DX (manufactured by Shin-Etsu Chemical Co., Ltd.), FZ-3720 (manufactured by Dow Corning Toray Co., Ltd.), BY16-839 (manufactured by Dow Corning Toray Co., Ltd.) and SF8411 (manufactured by Dow Corning Toray Co., Ltd.). Suitable specific examples of the epoxy group-containing long-chain alkyl compound include 1,2-epoxyhexane, 1,2-epoxyheptane, 1,2-epoxyoctane, 1,2-epoxydecane, 1,2-epoxydodecane, 1,2-epoxytetradecane, 1,2-epoxyhexadecane, 1,2-epoxyoctadecane and 1,2-epoxyicosane; alkyl glycidyl ether compounds such as butyl glycidyl ether, 2-ethylhexyl glycidyl ether and benzyl glycidyl ether; and long-chain alkyl carboxylic acid ester compounds such as butyric acid glycidyl ester, stearic acid glycidyl ester and neodecanoic acid glycidyl ester.

Next, regarding the production of the preferred colored resin particles used for example as toner particles, it is basically inferred that the acidic group at the surfaces of the colored resin particles collides with the epoxy group of the epoxy group-modified silicone compound and/or the epoxy group of the epoxy group-containing long-chain alkyl compound in the organic solvent, thereby allowing esterification (reaction) of the acidic group to proceed, the colored resin particles having the acidic group at the surfaces thereof are in an aggregated state at an early stage of the treatment (reaction), the compatibility of the colored resin particles with the organic solvent increases as the treatment (reaction) proceeds, and most of the colored resin particles in the aggregated state get into a state of primary particle dispersion at a late stage of the treatment (reaction). Therefore, the foregoing treatment is preferably carried out with agitation, and it is advisable to perform the agitation with an agitator, e.g., Three-One Motor, to such an extent that the entire reaction liquid flows. As agitation blades, flat turbine blades, propeller blades, anchor blades or the like may be used. Also, any of the following may be used: ultrasonic dispersing machines, pressurizing dispersing machines such as pressure-type homogenizers and mechanical homogenizers, and medium-type dispersing machines such as diamond fine mills, bead mills and sand grinders, with preference being given particularly to ultrasonic dispersing machines that are superior in dispersion efficiency. Further, the foregoing treatment may, if necessary, be carried out with heating, in which case the heating temperature is between room temperature and 80° C., preferably between room temperature and 50° C.

It is preferred that the epoxy group-modified silicone compound and/or the epoxy group-containing long-chain alkyl compound be added in an equivalent amount which is one to five times the acid value of the colored resin particles having the acidic group at the surfaces thereof and thus chemically modify the colored resin particles.

<Electrically Insulating Liquid>

The electrically insulating liquid contains an unsaturated group-containing silicone compound represented by General Formula (1) below.

General Formula (1)

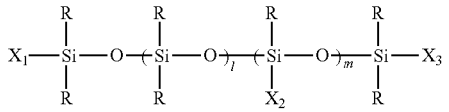

In General Formula (1), R independently denotes a methyl group or a phenyl group, l and m each independently denote an integer of 0 to 100, and $X_1$, $X_2$ and $X_3$ each independently denote a C1-C6 alkyl group or Substituent A below, with at least one of $X_1$, $X_2$ and $X_3$ being Substituent A.

Substituent A

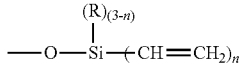

In Substituent A, R denotes a methyl group or a phenyl group, and n denotes an integer of 2 or 3.

The unsaturated group-containing silicone compound represented by General Formula (1) above can be easily produced by a known method. Specifically, the silicone compound can be obtained by reacting together a silicone compound with at least one of $X_1$, $X_2$ and $X_3$ in General Formula (1) being a hydroxyl group (silanol group) and a reactive silicone compound (silane coupling agent) represented by General Formula (4) below.

General Formula (4)

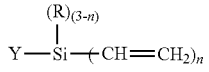

In General Formula (4), R denotes a methyl group or a phenyl group, n denotes an integer of 2 or 3, and Y denotes a halogen atom such as chlorine atom or bromine atom, a lower alkoxy group such as methoxy group or ethoxy group, or a group forming an acetic acid ester such as acetoxy group.

Regarding the reaction, the amount of the silicone compound with the hydroxyl group (silanol group) and the amount of the reactive silicone compound may be equal, but it is preferred that the amount of the reactive silicone compound be larger. If necessary, an acid catalyst or a basic catalyst may be used for the reaction. Examples of the acid catalyst include sulfuric acid and acetic acid, and examples of the basic catalyst include inorganic bases such as sodium hydroxide, potassium hydroxide, sodium carbonate and potassium carbonate, and organic bases such as triethylamine, tributylamine and N-methylmorpholine. It is preferable to allow the reaction to take place while removing water, alcohols and acetic acid, which are by-products produced during the reaction, to the outside of the reaction system. Also, a solvent may, if necessary, be used. This solvent for the reaction is selected from alcohols such as methanol and ethanol, ketones such as acetone and methyl ethyl ketone, hydrocarbons such as hexane, cyclohexane, toluene and xylene, and ethers such as tetrahydrofuran. The reaction temperature is between room temperature and 120° C., the reaction time is between several minutes and 12 hours or so, and an unreacted reactive silicone compound, etc. are preferably distilled away under reduced pressure after the reaction has finished.

Further, by using a reaction terminal treating agent represented by General Formula (5) below during the polysiloxane synthesis reaction, a silicone compound having unsaturated groups at both terminals, represented by General Formula (2) below, can be produced even more simply and inexpensively.

General Formula (5)

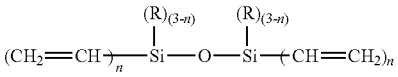

In General Formula (5), R independently denotes a methyl group or a phenyl group, and n denotes an integer of 2 or 3.

General Formula (2)

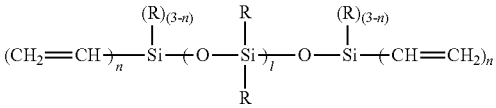

In General Formula (2), R independently denotes a methyl group or a phenyl group, l denotes an integer of 0 to 100, and n denotes an integer of 2 or 3.

As the method for synthesizing the polysiloxane, a known method can be utilized such as ring-opening polymerization of a cyclic siloxane, or equilibrium polymerization of a cyclic siloxane or chain siloxane. Among these, equilibrium polymerization can be favorably utilized because the molecular weight can be easily controlled, which enables polymerization with a narrow molecular weight distribution, and polysiloxane random copolymerization is possible. If necessary, an acid catalyst or a basic catalyst may be used for the equilibrium polymerization. Examples of the acid catalyst include hydrochloric acid, sulfuric acid, acetic acid, trifluoroacetic acid, methanesulfonic acid and trifluoromethanesulfonic acid, and examples of the basic catalyst include inorganic bases such as sodium hydroxide, potassium hydroxide, sodium carbonate, potassium carbonate and potassium silanolate, and organic bases such as tetramethylammonium hydroxide. The reaction temperature is set between room temperature and 150° C. and the reaction time is set between several minutes and 24 hours or so, thereby allowing the reaction to reach equilibrium; after the reaction has finished, low-molecular-weight products and unreacted raw materials are preferably distilled away under reduced pressure (stripping treatment).

The unsaturated group-containing silicone compound represented by General Formula (1) above, contained in the electrically insulating liquid, has very small effects on the resistance value of the electrically insulating liquid in comparison with conventionally known (meth)acrylic-modified silicones, and the resistance value of the electrically insulating liquid is close to that of dimethyl silicone oil. Also, regarding the electrically insulating liquid in the present invention, a nonreactive electrically insulating liquid may, if necessary, be added to the unsaturated group-containing silicone compound represented by General Formula (1) above for the purpose of adjusting liquid properties such as viscosity and resistance value. Examples of the nonreactive electrically insulating liquid include high-purity petroleums and silicone oils. Specific examples of commercially available products as the high-purity petroleums include ISOPAR G, H, L and M (manufactured by Exxon Chemical Company) and NORPAR 12 (manufactured by Exxon Chemical Company), and specific examples of commercially available products as the silicone oils include SH-200 Series (manufactured by Dow Corning Toray Co., Ltd.), KF-96 Series (manufactured by Shin-Etsu Chemical Co., Ltd.), L-45 Series (manufactured by Nippon Unicar Company Limited) and AK Series (manufactured by WACKER ASAHIKASEI SILICONE CO., LTD.). Among these nonreactive electrically insulating liquids, the silicone oils, in particular, can be suitably used. The amount of any of these nonreactive electrically insulating liquids used is preferably in the range of 0% by mass to 20% by mass relative to the amount of all the electrically insulating liquids. Use thereof in an amount of more than 20% by mass is not preferred because there may be a problem with curability.

The photocurable liquid developer can be produced by any of the following methods: (i) a method of redispersing a treated colorant (colored resin particles) in a photocurable electrically insulating liquid; (ii) a method of producing colored resin particles by chemically modifying colored resin particles having an acidic group at surfaces thereof, such as the ones described above, with an epoxy group-modified silicone compound and/or an epoxy group-containing long-chain alkyl compound in an organic solvent, then removing the organic solvent or performing filtration so as to sort out the colored resin particles and subsequently redispersing the colored resin particles in a photocurable electrically insulating liquid; and a method of producing the above colored resin particles in a photocurable electrically insulating liquid in one step. In the production of the photocurable liquid developer according to the present invention, the method of "producing the above colored resin particles in a photocurable electrically insulating liquid in one step" is particularly effective. This is due to the fact that the treatment (reaction) of the colored resin particles, which have the acidic group at the surfaces thereof, with the epoxy group-modified silicone compound and/or with the epoxy group-containing long-chain alkyl compound produces only an ester group and an alcoholic hydroxyl group as a result, and so additives (such as a catalyst) are not required, thereby greatly lessening effects on the electrical resistance of the photocurable liquid developer.

In the production of the photocurable liquid developer of the present invention, the amount of the colored resin particles included is preferably in the range of 0.5% by mass to 50% by mass, more preferably 1% by mass to 30% by mass, relative to the total amount of the photocurable liquid developer. When the amount of the colored resin particles included is less than 0.5% by mass, there may be a deficiency of coloring power and thus an adequate image density may not be secured in printed images. When the amount of the colored resin particles included is more than 50% by mass, the viscosity of the liquid developer is high, which causes the liquid developer in a printing apparatus to be inferior in conveyance property, elongation property and photocurability, and thus favorable printed images may not be obtained. The average particle diameter (weight average particle diameter) of the colored resin particles is preferably in the range of 0.3 μm to 5 μm. When the average particle diameter is greater than 5 μm, not only does the image quality decrease but also the colored resin particles easily precipitate when left to stand, possibly causing aggregation of the colored resin particles. When the average particle diameter is less than 0.3 μm, the colored resin particles increase in cohesive force and thus may be difficult to handle.

Examples of the other components which may, if necessary, be included in the photocurable liquid developer of the present invention include a wax and a charge controlling agent.

The wax is not particularly limited and may be suitably selected from known waxes. Examples thereof include paraffin waxes, polyethylene waxes, polypropylene waxes, polyester waxes, alcohol waxes and urethane waxes. These waxes may be used individually or in combination.

The charge controlling agent is not particularly limited and may be suitably selected from known charge controlling agents. Examples thereof include fluorochemical surfactants, metal-containing dyes such as azo compounds and salicylic acid metal complexes, quaternary ammonium salts, and azine dyes such as nigrosine. These may be used individually or in combination.

Further, known additives may, if necessary, be added to the photocurable liquid developer of the present invention. Examples thereof include a dispersant, a thermal stabilizer, an antiseptic, a surface tension adjuster, a polymerization inhibitor, an antioxidant, a near-infrared absorber, an ultraviolet absorber, a fluorescent agent and a fluorescent brightener. The polymerization inhibitor is added to prevent functional unsaturated group-containing monomer(s)/oligomer(s) of the photocurable electrically insulating liquid from reacting by heat, etc. Examples of the polymerization inhibitor include 2,6-di-tert-butyl-4-cresol, anthraquinone, hydroquinone and hydroquinone monomethyl ether. These may be used individually or in combination. Among these, 2,6-di-tert-butyl-4-cresol can be favorably used because it has very small effects on the electrical resistance of the photocurable liquid developer.

Figure 2:
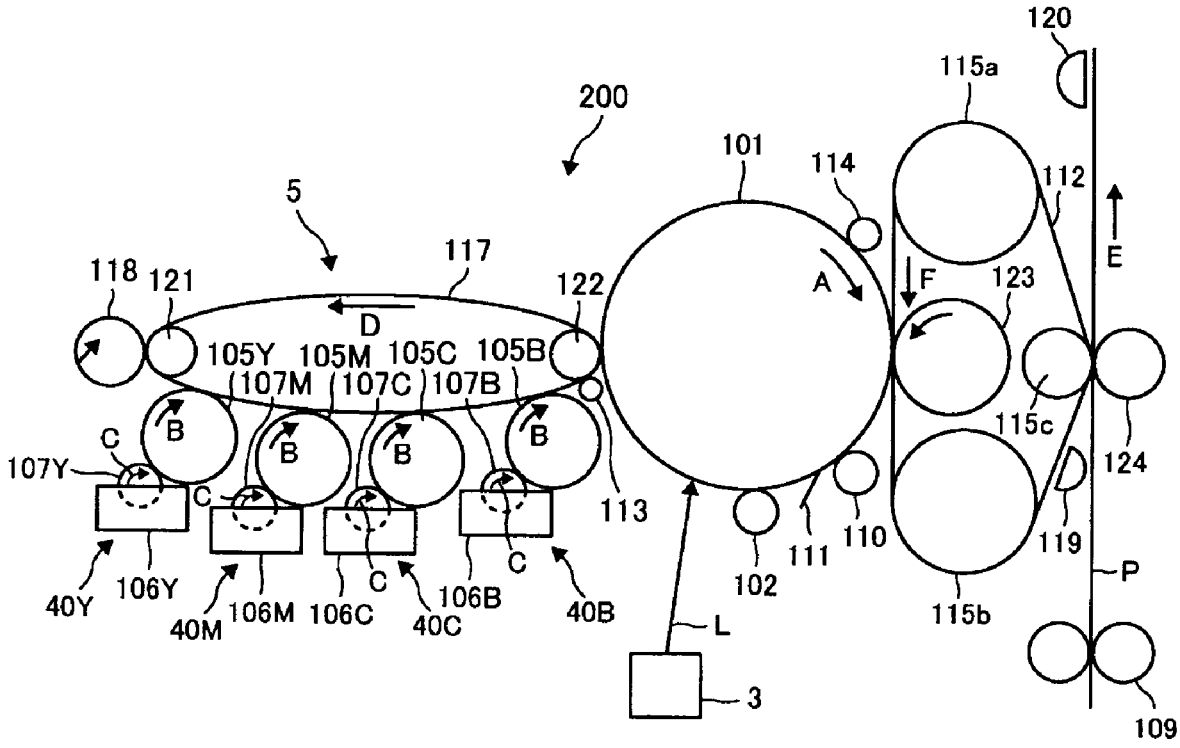
FIG. 2 is a drawing schematically showing the structure of an electrophotographic image forming apparatus according to another embodiment of the present invention.

Next, an electrophotographic developing device and an electrophotographic image forming apparatus which use the photocurable liquid developer according to the present invention will be explained referring to FIGS. 1 and 2. FIG. 1 is a drawing schematically showing the structure of an image forming apparatus according to an embodiment of the present invention. FIG. 2 is a drawing schematically showing the structure of an image forming apparatus according to another embodiment of the present invention.

In FIG. 1, the structure of an image forming apparatus for use in an image forming method according to an embodiment of the present invention is schematically shown. In this image forming apparatus, a photoconductor drum 1 (e.g., organic photoconductor (OPC)) serving as a latent image bearing member is placed at the approximate center of a base frame (not shown), and this photoconductor drum 1 is installed in such a manner as to be rotatable around a rotational axis (not shown). A document placement surface (not shown) for placing a document on is provided above this photoconductor drum 1, an image of the document on the document placement surface is read as an image signal by an image reading element (not shown), the read image signal is digitalized, subjected to image processing and sent to a conventional optical writing unit 3, and the optical writing unit 3 performs optical writing onto the photoconductor drum 1.

At this time, a latent electrostatic image is formed on the surface of the photoconductor drum 1 that has already been uniformly charged by a charger 2 and has reached the optical writing unit 3. Regarding this latent electrostatic image, the latent image in a predetermined area is removed by an erasing lamp 4, then the latent electrostatic image reaches a developing device 5 provided at a side of and facing the photoconductor drum 1. The developing device 5 changes the latent electrostatic image into a toner image by using a developing liquid, and this toner image reaches a transfer device 6 and is transferred, by corona discharge of a transfer charger 8, to transfer paper P (hereinafter referred to also as "recording medium P"), which is a recording sheet, sent from a paper feed unit (not shown). Thereafter, the transfer paper P with the toner image having been transferred thereto is separated from the surface of the photoconductor drum 1 by a separation charger (not shown), the toner image on the transfer paper is fixed by a fixing unit (not shown), and subsequently the transfer paper with the fixed toner image is discharged to a paper discharge tray (not shown) outside the base frame. After the transfer, the developing liquid remaining on the surface of the photoconductor 1 is removed by a cleaning device 9, then the charge is uniformly eliminated by a charge eliminating lamp 10, and a next image forming process starts.

Next, the developing device 5, the transfer device 6 and the cleaning device 9 in FIG. 1 will be further explained. The developing device 5 is a wet-type developing device using a developing liquid obtained by dispersing a toner in a carrier liquid and includes the following members: a container 51 which is supported by the base frame and has an opening formed on the side of the outer circumferential surface of the photoconductor drum 1; a developing roller 52 as a developing electrode and a squeeze roller 53 as a surplus liquid removing unit, pivotally supported in the container 51; a developing roller scraper 55, which is supported on an inner wall of the container 51 and whose lower end is in contact with and rubs against the developing roller 52; a squeeze roller scraper 57 which is supported on the inner wall of the container 51 and removes the developing liquid on the outer circumferential surface of the squeeze roller 53; and a supply nozzle 54 of a developing liquid supply pipe 58. Here, the rotational axes of the developing roller 52 and the squeeze roller 53 are set perpendicularly to the aspect shown in FIG. 1, and the developing roller 52 and the squeeze roller 53 are disposed on the upstream and downstream sides respectively with respect to the rotational direction of the outer circumferential surface of the photoconductor drum 1.

The developing roller 52 is placed with a space A provided between the outer circumferential surface thereof and the outer circumferential surface of the photoconductor drum 1, and is driven by a rotational driving unit 80 such that the outer circumferential surface thereof moves in a direction "b" that is the same as the moving direction "a" of the outer circumferential surface of the photoconductor drum 1. The squeeze roller 53 is placed with a space B provided between the outer circumferential surface thereof and the outer circumferential surface of the photoconductor drum 1, and is driven by a rotational driving unit 81 such that the outer circumferential surface thereof moves in a direction "c" that is opposite to the moving direction "a" of the outer circumferential surface of the photoconductor drum 1. The rear end of the developing roller scraper 55 is supported by a slide actuator 551 which is joined to a control unit 64 via a connection circuit (not shown). The developing roller scraper 55 is constructed such that its lower end can be switched between the position in which to rub against the outer circumferential surface of the developing roller 52 and a retreat position (not shown) in which to lie away from the outer circumferential surface. The rotational driving units 80 and 81 are joined to the side of a motor (not shown), which is a source of rotation, via respective rotational transmission members, and the driving of the rotational driving units 80 and 81 is controlled by the control unit 64 such that the developing roller 52 and the squeeze roller 53 rotate at predetermined rotational speed(s). Also, there is a rotational driving unit 82 provided for the photoconductor drum 1, and the driving of this rotational driving unit 82, too, is controlled by the control unit 64.

The lower end of the developing roller scraper 55 is in contact with and rubs against the outer circumferential surface of the developing roller 52 on the side opposite to the photoconductor drum 1, and a wedge portion 56 is formed between the developing roller and the developing roller scraper. Above the wedge portion 56, the supply nozzle 54 of the developing liquid supply pipe 58 is placed facing the wedge portion. The developing liquid supply pipe 58 is joined to a developing liquid tank 583 via a pipe 581 equipped with a pump 582. The developing liquid tank 583 accommodates the developing liquid returned from the container 51, and the developing liquid is controlled by a toner concentration adjusting unit (not shown) such that the ratio between the carrier liquid and the toner is kept in a constant allowable range. A pump motor 68 to drive the pump 582 is connected to a power source 69 via a drive switch 70, and this drive switch 70 is turned on/off by the drive unit 64.

The developing roller 52 serves also as a developing electrode, in which a conductive member is provided inside the skin of a dielectric, and the conductive member is connected to a bias circuit 60. This bias circuit 60 connects the developing roller 52 to first and second power sources 61 and 62 via a bias voltage switch 63. The first power source 61 applies a voltage for suctioning the toner in the developing liquid toward the developing roller 52, the second power source 62 applies a voltage for detaching the toner in the developing liquid from the developing roller 52, and the bias voltage switch 63 is switched by the control unit 64. Here, it should be noted that the bias voltage switch 63 may be dispensed with, by employing only the first power source 61 as a power source.

The squeeze roller 53 rotationally moves in the opposite direction to the moving direction of the surface of the photoconductor drum 1, with the space B maintained. This regulates the film thickness of the developing liquid attached to the surface of the photoconductor, and the swept-away developing liquid is made to flow to the bottom of the container 51 by the squeeze roller scraper 57. Regarding the squeeze roller 53, a conductive member is provided inside the skin of a dielectric, and the conductive member is connected to a bias circuit 73. This bias circuit 73 connects the squeeze roller 53 to first and second power sources 65 and 66 in a switchable manner via a bias voltage switch 67. The first power source 65 applies a voltage for suctioning the toner in the developing liquid toward the squeeze roller 53, the second power source 66 applies a voltage for detaching the toner in the developing liquid from the squeeze roller 53, and the bias voltage switch 67 is switched by the control unit 64.

Placed facing the outer circumferential surface of the photoconductor drum 1, a developing liquid supply unit 90 is positioned downstream of the place where the developing roller 52 faces the photoconductor drum and upstream of the place where the squeeze roller 53 faces the photoconductor drum. This developing liquid supply unit 90 can directly supply the developing liquid as a supplementary liquid to a supply position C where the squeeze roller 53 faces the photoconductor surface. The developing liquid supply unit 90 includes a supplementary liquid nozzle 91 placed facing the surface of the photoconductor drum 1; a supplementary liquid supply pipe 92 which can join this nozzle and the developing liquid tank 583 together; and a pump 93 on the supplementary liquid supply pipe 92. A pump motor 94 to drive the pump 93 is connected to a power source 99 via a drive switch 95, and this drive switch 95 is turned on/off by the drive unit 64.

The transfer device 6 is in the formed of a belt and includes a transfer member 12 whose surface is covered with a dielectric, and a transfer charger 8 placed facing the photoconductor surface at the transfer position, with the transfer member 12 situated in between. When driven, this transfer device transfers a toner image formed on the photoconductor drum 1 onto the transfer paper P by corona discharge of the transfer charger 8. At this time, the belt-like transfer member 12 is driven so as to move at the same speed as the outer circumferential surface of the photoconductor drum 1 by means of a drive unit (not shown), moves the fed transfer paper P at the same speed while bringing it into contact with the surface of the photoconductor drum 1 and transfers the toner image formed on the photoconductor surface onto the transfer paper P by electric force provided by the transfer charger 8. The cleaning device 9 removes the developing liquid remaining on the photoconductor drum 1 after the transferring, and includes a movable plate member 13 which can touch and detach from the photoconductor drum 1, and an actuator 71 which switches the movable plate member 13 between the cleaning position shown by the solid line and the retreat position shown by the broken line. The actuator 71 is a solenoid, and its drive is output from a drive circuit 72 instructed by the control unit 64.

As described above, a colored image containing colored resin particles is appropriately fixed on the recording medium P, and detachment of the colored image from the recording medium P is surely prevented.

Next, a case where a color image is formed on a recording medium P will be explained referring to FIG. 2.

An electrophotographic image forming apparatus 200 for forming color images, shown in FIG. 2, includes a drum-like photoconductor 101 as an image bearing member which rotates in the direction of the arrow A; a developing device 5 including developer supply units 40Y, 40M, 40C and 40B configured to supply photocurable liquid developers of yellow, magenta, cyan and black respectively; and an intermediate transfer belt 112 in the form of an endless belt, supported by a drive roller 115*a* and support rollers 115*b* and 115*c* and moved in the direction of the arrow F.

The developing device 5 also includes a conveyance belt 117 in the form of an endless belt, supported by a drive roller 121 and a support roller 122 and moved in the direction of the arrow D. The photocurable liquid developers of yellow, magenta, cyan and black are supplied to this conveyance belt 117 from the developer supply units 40Y, 40M, 40C and 40B respectively, colored resin particles in the supplied photocurable liquid developers are charged by a corona discharge unit 113, and the photocurable liquid developers are supplied to the photoconductor 101 in a position over the support roller 122. The developer supply units 40Y, 40M, 40C and 40B respectively include liquid developer containers 106Y, 106M, 106C and 106B that accommodate the yellow, magenta, cyan and black photocurable liquid developers each including colored resin particles and a photocurable electrically insulating liquid which contains an unsaturated group-containing silicone compound represented by General Formula (1) above. Also, the developer supply units respectively include developer supply rollers 107Y, 107M, 107C and 107B which draw the photocurable liquid developers from the liquid developer containers 106Y, 106M, 106C and 106B while rotating in the direction of the arrow C, and developing rollers 105Y, 105M, 105C and 105B which supplies the photocurable liquid developers, supplied from the developer supply rollers 107Y, 107M, 107C and 107B in such a manner as to have a predetermined coating thickness, to the surface of the conveyance belt 117 while rotating in the direction of the arrow B.

In this case, the yellow, magenta, cyan and black photocurable liquid developers are supplied from the developer supply units 40Y, 40M, 40C and 40B to the conveyance belt 117 correspondingly to latent electrostatic images for each color formed on the photoconductor 101 by a writing exposure unit 104 according to image information of each color. Specifically, when a latent electrostatic image for yellow has been formed, only the yellow photocurable liquid developer is supplied from the yellow developer supply unit 40Y to the conveyance belt 117 and then to the latent electrostatic image on the photoconductor 101, thereby developing the latent electrostatic image into a yellow liquid developer image. The yellow liquid developer image thus formed is charged by a corona discharger 114 and transferred onto the intermediate transfer belt 112 by a primary transfer roller 123. Similarly, when a liquid developer image corresponding to a magenta image is to be formed, the magenta photocurable liquid developer is supplied from the developer supply unit 40M to the photoconductor 101 so as to form a magenta liquid developer image. This magenta liquid developer image is transferred so as to be superimposed onto the yellow liquid developer image that has been transferred onto the intermediate transfer belt 112. Carrying out similar processes, cyan and black liquid developer images are transferred so as to be superimposed onto the liquid developer images on the intermediate transfer belt 112, and a color image is thus formed.

The color liquid developer image thus formed on the intermediate transfer belt 112 is partially cured by a pre-transfer light irradiation unit 119 and thus provided with surface adhesiveness. The color liquid developer image thus provided with surface adhesiveness is transferred by a secondary transfer roller 124 onto a recording medium P (e.g., transfer paper) conveyed by a registration roller 109 in the direction of the arrow E with calculated timing. The color liquid developer image transferred onto the recording medium P is photocured by being irradiated with ultraviolet rays by a fixation light irradiation unit 120, and thus fixed on the recording medium P.

Parenthetically, in this image forming apparatus 200, the photocurable liquid developers remaining on the conveyance belt 117 and/or the photoconductor 101 are removed and cleaned off by a cleaning roller 118, a cleaning roller 110 and a cleaning blade 111, and an initial state is restored.

As described above, a colored image containing colored resin particles is appropriately fixed on the recording medium P, and detachment of the colored image from the recording medium P is surely prevented.

The following explains a case where the photocurable liquid developer according to the present invention is applied to an inkjet recording method in which printing is performed by flying the photocurable liquid developer to a recording medium and thusly forming recording dots thereon.

Inkjet recording methods, in which printing is performed by flying an ink to a recording medium and thusly forming recording dots thereon, are attracting interest as nonimpact recording methods that facilitate colorization and enable direct recording onto plain paper, and a variety of printers using these methods have been put to practical use. The inkjet recording methods are broadly classified into on-demand (on-demand jetting) methods and continuous (continuous jetting) methods. Further, known examples of the continuous methods include recording methods such as electrostatic method (sweet type, hertz type), and known examples of the on-demand methods include recording methods such as piezoelectric method, shear-mode piezoelectric method and thermal inkjet method. For instance, the method referred to as "electrostatic acceleration type inkjet method" or "slit jet method", described in "IEICE TRANSACTIONS on Fundamentals of Electronics, Communications and Computer Sciences Vol. J66-C (No. 1), P47 (1983) by Susumu Ichinose and Yuji Oba", and "The Journal of the Institute of Image Electronics Engineers of Japan Vol. 10 (no. 3), P157 (1981) by Tadayoshi Ohno and Mamoru Mizuguchi", is known as one of the on-demand inkjet recording methods.

The photocurable liquid developer including the electrically insulating liquid which contains the unsaturated group-containing silicone compound represented by General Formula (1) above can be suitably used in a piezoelectric method and a shear-mode piezoelectric method. Note that the photocurable liquid developer in these methods differs from the above photocurable liquid developer in an electrophotographic method in terms of such a limiting condition that the particle diameter of the colored resin particles basically has to be smaller than the nozzle diameter of an inkjet head. Specifically, the diameter of the colored resin particles is preferably in the range of 0.001 μm to 0.5 μm, more preferably 0.01 μm to 0.3 μm. To produce toner particles with the above colored resin particle diameter, use of the above-mentioned coacervation method or a known emulsion polymerization method is preferable. In this emulsion polymerization method, radical polymerizable monomer(s) and a colorant are emulsified in a forced manner in water and a surfactant, a radical polymerization initiator is added, the polymerization temperature is adjusted to the range of 40° C. to 100° C., preferably 50° C. to 90° C., the polymerization time is adjusted to the range of 1 hour to 10 hours, preferably 2 hours to 8 hours, and desired colored resin particles having an acidic group at surfaces thereof are thus obtained.

In this case, examples of the radical polymerization initiator used include water-soluble radical polymerization initiators such as 2,2'-azobis[2-methyl-n-(2-hydroxyethyl)propionamide], 2,2'-azobis(2-methylpropionamidine) salt and 4,4'-azobis(4-cyanovaleric acid). Also, a dispersion stabilizer may, if necessary, be used. Colored resin particles having an acidic group at surfaces thereof can be produced, with compounds (such as the radical polymerizable monomer(s), the surfactant and the dispersion stabilizer) and an operational method being similar to those in the above explanation of the dispersion polymerization.

Further, the photocurable liquid developer applied to an inkjet recording method may include colored resin particles obtained by chemically modifying the thusly produced colored resin particles, which have the acidic group at the surfaces thereof, with at least one of an epoxy group-modified silicone compound and an epoxy group-containing long-chain alkyl compound as described above. Also, these colored resin particles may be used with the photocurable liquid developer including the electrically insulating liquid which contains the unsaturated group-containing silicone compound represented by General Formula (1) above.

There is a further usable method in which, without using small-particle-diameter colored resin particles produced by a polymerization method or the like such as the colored resin particles described above, a commercially available colorant is directly dispersed into the present invention's electrically insulating liquid that contains the unsaturated group-containing silicone compound represented by General Formula (1) above. In this case, a dispersant or a dispersion stabilizer may, if necessary, be added.

As the dispersant and the dispersion stabilizer, polyether-modified silicone oils can be suitably used. Specific examples of the polyether-modified silicone oils as commercially available products include KF-945, KF-6020, KF-352A, KF-353, KF-615A, X-22-4515, KF-6012, KF-6015 and KF-6017 (manufactured by Shin-Etsu Chemical Co., Ltd.), and FZ-2154, FZ-2191, FZ-2130, SH-8400 and FZ-2123 (manufactured by Dow Corning Toray Co., Ltd.). Among these, polyether-modified silicone oils having HLB values of 2 to 10 can be suitably used, particularly polyether-modified silicone oils having HLB values of 4 to 7 such as KF-945, KF-6020, FZ-2154 and FZ-2130.

Further, as for a pigment dispersion method, any of the above treated colorants (colored resin particles) can be favorably used. Specifically, a treated colorant having an acidic group at its surface based upon an acidic group-containing resin used as a carrier resin, among the above treated colorants, is chemically modified with an epoxy group-modified silicone compound and/or an epoxy group-containing long-chain alkyl compound in the electrically insulating liquid which contains the unsaturated group-containing silicone compound represented by General Formula (1) above; by doing so, dispersion of the colorant and dispersion stabilization yielded by the reaction between the acidic group of the carrier resin and the epoxy group proceed simultaneously, and thus an excellent liquid developer can be produced.

Also, since basically the electrostatic acceleration type inkjet method does not use a nozzle of an inkjet head and therefore the colored resin particle diameter is not restricted, it is possible to use any of a photocurable liquid developer for an electrophotographic method, a photocurable liquid developer for a piezoelectric method and a photocurable liquid developer for a shear-mode piezoelectric method.

Further, known additives may, if necessary, be added to the photocurable liquid developer of the present invention. Examples thereof include a dispersant, a thermal stabilizer, an antiseptic, a surface tension adjuster, a polymerization inhibitor, an antioxidant, a near-infrared absorber, an ultraviolet absorber, a fluorescent agent and a fluorescent brightener.

The polymerization inhibitor is added to prevent functional unsaturated group-containing monomer(s)/oligomer(s) of the photocurable electrically insulating liquid from reacting by heat, etc. Examples of the polymerization inhibitor include 2,6-di-tert-butyl-4-cresol, anthraquinone, hydroquinone and hydroquinone monomethyl ether. These may be used individually or in combination.

Further, a charge controlling agent may be added for dispersion stability that is affected by zeta potential. The charge controlling agent is not particularly limited and may be suitably selected from known charge controlling agents. Examples thereof include fluorochemical surfactants, metal-containing dyes such as azo compounds and salicylic acid metal complexes, quaternary ammonium salts, and azine dyes such as nigrosine. These may be used individually or in combination.

Next, a method of photocuring the photocurable liquid developer according to the present invention will be explained.

After an image formed with the photocurable liquid developer of the present invention is developed, the developed liquid developer image is irradiated with light so as to solidify the photocurable electrically insulating liquid on the liquid developer image. The photocuring can be carried out before and/or after the transfer of the liquid developer image to a recording medium. The pre-transfer light irradiation partially cures the developed liquid developer image before the transfer, provides the developed liquid developer image with surface adhesiveness and promotes transfer thereof to the recording medium (adhesive transfer method). The post-transfer light irradiation allows curing of the developed liquid developer image to proceed and makes it possible to greatly promote adhesion thereof to the recording medium. The photocuring can be performed by a certain known method; in the case where a photopolymerization initiator is used, the curing is performed by irradiating and exposing the liquid developer image to active energy rays with a wavelength to which the initiator is sensitive, such as ultraviolet rays.

Here, the active energy rays used are preferably selected from electron rays, ultraviolet rays and visible rays, and the peak wavelength of the active energy rays is, for example, preferably in the range of 300 nm to 450 nm, although this depends upon the absorption properties of a sensitizer. It is appropriate that the active energy rays, used for the curing system applied to the photocurable liquid developer of the present invention, be applied at an exposure surface illuminance of 100 mW/cm$^2$ to 20,000 mW/cm$^2$. As active energy ray sources, mercury lamps and gas/solid-state lasers are primarily utilized; in particular, as light sources used to cure ultraviolet curable liquid developers, mercury lamps and metal halide lamps are widely known.

However, at present, use of mercury-free sources is strongly demanded to protect the environment, and replacement of the mercury-based sources by GaN-based semiconductor ultraviolet devices is very advantageous both industrially and environmentally. Further, being compact and highly efficient and having long lifetimes, LEDs (light emitting diodes) (UV-LEDs) and LDs (UV-LDs) are expected to be used as light sources for photocurable liquid developers.

Further, the photocurable liquid developer of the present invention may also include a photopolymerization initiator to initiate curing of the electrically insulating liquid which contains the unsaturated group-containing silicone compound. The photopolymerization initiator is not particularly limited and may be suitably selected from known photopolymerization initiators. Preferred specific examples of the photopolymerization initiator include benzoin, benzoin methyl ether, benzoin ethyl ether, benzoin isopropyl ether, benzoin-n-butyl ether, benzoin isobutyl ether, acetophenone, dimethylacetophenone, 2,2-dimethoxy-2-phenylacetophenone, 2,2-diethoxy-2-phenylacetophenone, 2-hydroxy-2-methyl-1-phenylpropan-1-one, 1-hydroxycyclohexyl phenyl ketone, 2-methyl-1-[4-(methylthio)phenyl]-2-morpholinopropan-1-one, 4-(2-hydroxyethoxy)phenyl-2-hydroxy-2-propylketone, benzophenone, p-phenylbenzophenone, 4,4-diethylaminobenzophenone, dichlorobenzophenone, 2-methylanthraquinone, 2-ethylanthraquinone, 2-tert-butylanthraquinone, 2-aminoanthraquinone, 2-methylthioxanthone, 2-ethylthioxanthone, 2-isopropylthioxanthone, 2-chlorothioxanthone, 2,4-dimethylthioxanthone, 2,4-diethylthioxanthone, benzyl dimethyl ketal, acetophenone dimethyl ketal, 2,4,6-trimethylbenzoyldiphenylphosphine oxide, 6-trimethylbenzoyldiphenylphosphine oxide, 2-benzyl-2-dimethylamino-1-(4-morpholinophenyl)-butan-1-one, bis(2,6-dimethoxybenzoyl)-2,4,4-trimethylpentylphosphine oxide and p-dimethylaminobenzoate. These may be used individually or in combination.

Normally, it is preferred that the amount of the photopolymerization initiator included be in the range of 0.05% by mass to 20% by mass, more preferably 2% by mass to 15% by mass, relative to the total amount of the photocurable liquid developer. Any of the above photopolymerization initiators may be added before or after the development of an image.

In general, properties required for a photocurable liquid developer are as follows.

(Curability)

When an image, for example for graphic art, a sign, a display or a label, is formed using a liquid developer, high productivity is demanded as a matter of course. Moreover, in the case where an image is formed with a photocurable film, the liquid developer provided onto a recording medium should not cause smearing or peeling by being attached to other recording media or a user. Accordingly, it is strongly desired that a curable film be formed in a short period of time after the start of light irradiation. Also, the liquid developer provided onto the recording medium may move on the recording medium due to its fluidity, causing problems with image quality, such as flowing, bleeding and repellency. To reduce or prevent these problems, properties that allow the liquid developer to cure quickly by light irradiation and be fixed on the recording medium are very important.

(Liquid Properties)

For high-speed driving in providing the liquid developer to a recording medium, such liquid properties as relatively low viscosity and superior dispersibility and dispersion stability of the colored resin particles are preferred. Also, at the same time, reduction in the particle diameter of the colored resin particles is desired due to the present-day increase in image quality, and so it is important that these opposing properties including low viscosity, high dispersibility and reduction in particle diameter be satisfied at a high level and in a combined manner.

(Curable Film Properties)

There are broadly three properties required for the curable film. One of the properties is strength of the curable film. In the case where an image is used for a display, label, etc., the image may be damaged owing to rubbing, scratching or writing by a user, the effects of dust, etc., and thus such film strength as makes it possible to protect the image from the damage is necessary. Another one of the properties is adhesion of the curable film to a recording medium. An image should not be lifted or detached from a recording medium even when exposed to an unfavorable environment or given forces such as rolling force and folding force, and so it is demanded that the curable film firmly and uniformly adhere to the recording medium. Yet another one of the properties is reduced stickiness of the curable film. For example, when a cured film has stickiness like the stickiness of glue, there may be adhesion of images to each other, smearing, etc. and thus the value of the images may be considerably impaired. Therefore, reduced stickiness of the curable film is an important property.

(Stability)

Similarly to ordinary inks, liquid developers could possibly be distributed on the market and stored, and could possibly remain in apparatuses. Accordingly, it is necessary to avoid degradation of the performance of the liquid developers caused, for example, by thickening, curing or decomposition of ingredients in such a short period of time as cannot be socially accepted. It goes without saying that sufficient sustenance of curability is an important property. Also, these liquid developers are often used in combination with additives such as charge controlling agents, in which case any reaction between the liquid developers and the additives which impairs the intended properties should be avoided.

The photocurable liquid developer including the unsaturated group-containing silicone compound represented by General Formula (1) above, according to the present invention, can sufficiently satisfy the above properties and is a compound which is chemically stable and superior in safety in comparison with an ordinary silicone compound having a functional group such as methacryloxy group in its molecule.

Further, the photocurable liquid developer makes it possible to form high-resolution images without background smears or image blurring.

Furthermore, by producing the colored resin particles according to the present invention by a polymerization method or salting-out method so as to be highly monodisperse and homogeneous, the stability of fundamental properties related to electrophoresis, such as mobility, is enhanced; further, the presence of the siloxyl group and/or the long-chain alkyl group at the surfaces of the colored resin particles makes additives such as a dispersant not necessary and yields superior dispersibility and redispersibility of the colored resin particles; also, regarding the photocurable liquid developer, when carefully-selected materials are used in the smallest possible amounts required, higher resolution and higher stability can be yielded. In addition, since the photocurable liquid developer according to the present invention can be produced by a very simple method, stable developer properties can be obtained and printed images of favorable quality can be produced in a highly reliable manner.

EXAMPLES

The following specifically explains the present invention, referring to Examples. It should, however, be noted that the scope of the present invention is not confined to these Examples.

First of all, methods and apparatuses used in evaluating photocurable liquid developers are mentioned below.

(Measurement of Average Particle Diameter and Relative Standard Deviation (CV Value))

Measurement apparatus: Particle Size Analyzer FPAR-1000 (manufactured by Otsuka Electronics Co., Ltd.)

Sample: Measurement was carried out using 1.0% (by mass) aqueous solution.

(Measurement of Acid Value)

The acid value was measured in accordance with JIS K0070.

(Measurement of Viscosity)

As for the viscosity, the value of viscosity at 25° C. measured using a rotary viscometer was employed.

Synthesis Example I-1

—Production of Colored Resin Particles with Acidic Group at Surfaces Thereof by Polymerization Method—

Using a homogenizer (ULTRA-TURRAX T25, manufactured by IKA), 0.184 parts by mass of potassium dihydrogen phosphate, 9.17 parts by mass of 1N potassium hydroxide, 189 parts by mass of methanol and 71.84 parts by mass of ion-exchange water were stirred at high speed (9,500 rpm); while doing so, 1.5 parts by mass of a (meth)acrylic acid/(meth)acrylic acid ester macromonomer (XM-9053, manufactured by TOAGOSEI CO., LTD.) (weight average molecular weight (Mw): 8,700, acid value: 199 mgKOH/g) and 3.0 parts by mass of phthalocyanine blue (C.I. Pigment Blue 15:3) as a treated colorant (colored resin particles) were added in this order, then a solution composed of 20.4 parts by mass of methyl methacrylate as a polymerizable monomer, 5.1 parts by mass of N,N-dimethylacrylamide as a polymerizable monomer and 0.419 parts by mass of an oil-soluble polymerization initiator (product name: "V-60", 2,2'-azobis (isobutyronitrile), manufactured by Wako Pure Chemical Industries, Ltd.) was poured, and the ingredients were mixed together with high-speed stirring for 30 minutes. In this manner, a reaction liquid was obtained.

Subsequently, the reaction liquid was poured into a previously prepared 500 mL separable flask equipped with a stirrer, a thermometer, a reflux condenser and a nitrogen-introducing tube, and the temperature was increased to 67° C. while carrying out stirring with a nitrogen stream. The reaction liquid was subjected to reaction for a further 8 hours, then the reaction liquid was cooled, filtered, washed twice with water and freeze-dried, and 24.36 parts by mass of colored resin particles (A) having a carboxyl group at surfaces thereof were thus obtained. As a result of measuring the particle size distribution of these particles, the average particle diameter thereof was 1.2 μm and the relative standard deviation (CV value) of the particle diameters was 21%. The acid value of the particles was 9.1 mgKOH/g.

Synthesis Example I-2

—Production of Colored Resin Particles with Acidic Group at Surfaces Thereof by Salting-Out Method—

A 10% (by mass) UC-3900 aqueous solution composed of 350.2 parts by mass of water, 9.17 parts by mass of 1N potassium hydroxide and 50 parts by mass of a carboxyl group-containing styrene acrylic resin (UC-3900, manufactured by TOAGOSEI CO., LTD.) (weight average molecular weight (Mw): 4,600, acid value: 112 mgKOH/g) was prepared in advance. Using a homogenizer (ULTRA-TURRAX T25, manufactured by IKA), 240 parts by mass of the 10% (by mass) UC-3900 aqueous solution was stirred at high speed (9,500 rpm); while doing so, a dispersion liquid prepared by wetting 10 parts by mass of phthalocyanine blue (C.I. Pigment Blue 15:3) with 27 parts by mass of methanol was added, then dispersion was carried out for 30 minutes, and a colorant dispersion liquid was thus produced.

Subsequently, the colorant dispersion liquid was poured into a previously prepared 1,000 mL separable flask equipped with a stirrer, a thermometer and a reflux condenser, then the temperature was increased to 30° C. while carrying out stirring, and 90 parts by mass of a 5% (by mass) potassium sulfate aqueous solution was added dropwise for 1 hour. Stirring was carried out for a further 5 hours, then the mixture was cooled, acidified with 2N $H_2SO_4$, filtered, washed twice with water and freeze-dried, and 28.09 parts by mass of colored resin particles (B) having a carboxyl group at surfaces thereof were thus obtained. As a result of measuring the particle size distribution of these particles, the average particle diameter thereof was 1.8 μm and the relative standard deviation (CV value) of the particle diameters was 28%. The acid value of the particles was 62.8 mgKOH/g.

Synthesis Example I-3

—Production of Colored Resin Particles with Acidic Group at Surfaces Thereof by Salting-Out Method—

A 10% (by mass) UC-3000 aqueous solution composed of 537.68 parts by mass of water, 92.32 parts by mass of 1N potassium hydroxide and 50 parts by mass of a carboxyl group-containing acrylic resin (UC-3000, manufactured by TOAGOSEI CO., LTD.) (weight average molecular weight (Mw): 10,000, acid value: 74 mgKOH/g) was prepared in advance. Using zirconia balls (2 mm in diameter), 120 parts by mass of the 10% (by mass) UC-3000 aqueous solution and 3 parts by mass of phthalocyanine blue (C.I. Pigment Blue 15:3) were subjected to ball-mill treatment for 12 hours, and a ball-mill colorant dispersion liquid was thus produced.

Subsequently, a colorant dispersion liquid obtained by removing the zirconia balls from the ball-mill colorant dispersion liquid was poured into a previously prepared 500 mL separable flask equipped with a stirrer, a thermometer and a reflux condenser, then cooling was carried out such that the temperature lowered to 5° C. while carrying out stirring, and 90 parts by mass of a saturated ammonium sulfate aqueous solution was added dropwise for 2 hours. Stirring was carried out for a further 1 hour, then the mixture was acidified with 0.1N $H_2SO_4$, filtered, washed twice with water and freeze-dried, and 14.03 parts by mass of colored resin particles (D) having a carboxyl group at surfaces thereof were thus obtained. As a result of measuring the particle size distribution of these particles, the average particle diameter thereof was 0.8 μm and the relative standard deviation (CV value) of the particle diameters was 22%. The acid value of the particles was 39.2 mgKOH/g.

Comparative Synthesis Example II-1

—Production of Colored Resin Particles by Coacervation Method—

Into a container equipped with a thermometer and a reflux condenser, 800 parts by mass of a branched-chain aliphatic hydrocarbon (ISOPAR G, manufactured by Exxon Chemical Company), 480 parts by mass of toluene and 300 parts by mass of ethanol were poured. Further, 66.7 parts by mass of a partially saponified product of an ethylene-vinyl acetate copolymer (DUMILAN C-2280, manufactured by Takeda Pharmaceutical Company Limited), 13.3 parts by mass of phthalocyanine blue (C.I. Pigment Blue 15:3) and 8 parts by mass of a phosphoric acid ester surfactant (PLYSURF AL, manufactured by DAI-ICHI KOGYO SEIYAKU CO., LTD.) were added, then high-speed stirring was carried out at 70° C. for 3 hours, and a phthalocyanine blue dispersion liquid was thus produced.

This phthalocyanine blue dispersion liquid was slowly cooled to 30° C. with weak stirring, the toluene and the ethanol were distilled away under reduced pressure so as to deposit colored resin particles, the colored resin particles were sorted out by filtration and dried under reduced pressure, and 76.4 parts by mass of colored resin particles (C) were thus obtained. As a result of measuring the particle size distribution of these particles, the average particle diameter was 2.3 μm and the relative standard deviation (CV value) of the particle diameters was 320%.

Synthesis Example III-1

—Synthesis of Unsaturated Group-containing Silicone Compound: Polydimethylsiloxane with Trivinyl Group at Both Terminals—

Into a 500 mL container equipped with a stirrer, a thermometer, a reflux condenser and a nitrogen introducing tube, 178 parts by mass of octamethylcyclotetrasiloxane (D4, manufactured by TOKYO CHEMICAL INDUSTRY CO., LTD.), 23.45 parts by mass of hexavinyldisiloxane (manufactured by AZmax. co) and 0.20 parts by mass of trifluoromethanesulfonic acid were poured, and the temperature was increased to 80° C. while carrying out stirring with a nitrogen stream. Reaction was continued for a further 12 hours, then the temperature was cooled to room temperature, subsequently an ether was added, an ether phase was washed with water, and a catalyst was removed. Subsequently, low-molecular-weight by-products were removed by heating under reduced pressure, and an intended unsaturated group-containing silicone compound (X) was thus obtained.

Synthesis Example III-2

—Synthesis of Unsaturated Group-containing Silicone Compound: Polydimethylsiloxane with Divinylmethyl Group at Both Terminals—

An intended unsaturated group-containing silicone compound (Y) was obtained in the same manner as in Synthesis Example III-1, except that 21.04 parts by mass of 1,1,3,3-tetravinyldimethyldisiloxane (manufactured by AZmax. co) was used instead of 23.45 parts by mass of the hexavinyldisiloxane (manufactured by AZmax. co).

Synthesis Example III-3

—Synthesis of Unsaturated Group-containing Silicone Compound: Polydimethylsiloxane with Trivinyl Group at Both Terminals—

Hexavinyldisiloxane (manufactured by AZmax. co) and octamethylcyclotetrasiloxane (D4, manufactured by TOKYO CHEMICAL INDUSTRY CO., LTD.) were subjected to equilibrium polymerization with potassium silanolate and then neutralized with trichlorosilane, low-molecular-weight siloxanes were distilled away at 200° C. under a reduced pressure of 10 mmHg, and an intended dimethylsiloxane (X) with both terminals of its molecular chain being blocked with a trivinylsiloxy group was thus obtained. The viscosity of the dimethylsiloxane (X) was 25 mPa·s.

Synthesis Example III-4

—Synthesis of Unsaturated Group-containing Silicone Compound: Polydimethylsiloxane with Divinylmethyl Group at Both Terminals—

An intended dimethylsiloxane (Y) with both terminals of its molecular chain being blocked with a divinylmethylsiloxy group was obtained in the same manner as in Synthesis Example III-3, except that 1,1,3,3-tetravinyldimethyldisiloxane (manufactured by AZmax. co) was used instead of the hexavinyldisiloxane (manufactured by AZmax. co). The viscosity of the dimethylsiloxane (Y) was 18 mPa·s.

Comparative Synthesis Example IV-1

—Synthesis of Unsaturated Group-containing Silicone Compound: Polydimethylsiloxane with Vinyldimethyl Group at Both Terminals—

An intended unsaturated group-containing silicone compound (Z) was obtained in the same manner as in Synthesis Example III-1, except that 21.04 parts by mass of 1,3-divinyltetramethyldisiloxane (manufactured by AZmax. co) was used instead of 23.45 parts by mass of the hexavinyldisiloxane (manufactured by AZmax. co).

Comparative Synthesis Example IV-2

—Synthesis of Unsaturated Group-containing Silicone Compound: Polydimethylsiloxane with Dimethylvinyl Group at Both Terminals—

An intended dimethylsiloxane (Z) with both terminals of its molecular chain being blocked with a dimethylvinyl group was obtained in the same manner as in Synthesis Example III-3, except that 1,3-divinyltetramethyldisiloxane (manufactured by AZmax. co) was used instead of the hexavinyldisiloxane (manufactured by AZmax. co). The viscosity of the dimethylsiloxane (Z) was 37 mPa·s.

Example 1

Into a 500 mL beaker, 20 parts by mass of the colored resin particles (A) having the carboxyl group at the surfaces thereof, obtained in Synthesis Example I-1, 176.85 parts by mass of the unsaturated group-containing silicone compound (X) obtained in Synthesis Example III-3, and 3.15 parts by mass (which is an equivalent amount that is 1.0 time the acid value of the colored resin particles (A)) of an epoxy-modified silicone oil compound (MCR-E11, manufactured by AZmax.co) were poured, then a dispersion treatment was carried out for 2 hours using an ultrasonic dispersing machine (output: 130 W, frequency: 20 kHz, pulsar type), 10 parts by mass of 15% (by mass) zirconium octylate (manufactured by NIHON KAGAKU SANGYO CO., LTD.) was added, and a liquid developer (1) was thus obtained. The average particle diameter of this liquid developer (1) was 1.3 μm, and the relative standard deviation (CV value) of the particle diameters was 25%. Also, as a result of conducting a test in which this dispersion liquid was stored for 20 days, the average particle diameter thereof was 1.3 μm, aggregation of particles did not arise and excellent storage stability was exhibited.

Example 2

Into a 500 mL beaker, 20 parts by mass of the colored resin particles (B) having the carboxyl group at the surfaces thereof, obtained in Synthesis Example I-2, 171.60 parts by mass of the unsaturated group-containing silicone compound (X) obtained in Synthesis Example III-3, and 8.40 parts by mass (which is an equivalent amount that is 1.0 time the acid value of the colored resin particles (B)) of an epoxy-modified silicone oil compound ((3-glycidoxypropyl)bis(trimethylsiloxy)methylsilane) (manufactured by TOKYO CHEMICAL INDUSTRY CO., LTD.) were poured, then a dispersion treatment was carried out for 2 hours using an ultrasonic dispersing machine (output: 130 W, frequency: 20 kHz, pulsar type), 10 parts by mass of 15% (by mass) zirconium octylate (manufactured by NIHON KAGAKU SANGYO CO., LTD.) was added, and a liquid developer (2) was thus obtained. The average particle diameter of this liquid developer (2) was 1.9 μm, and the relative standard deviation (CV value) of the particle diameters was 30%. Also, as a result of conducting a test in which this dispersion liquid was stored for 20 days, the average particle diameter thereof was 2.0 μm, aggregation of particles did not arise and excellent storage stability was exhibited.

Example 3

A liquid developer (3) was obtained in the same manner as in Example 2 except that 5.58 parts by mass (which is an equivalent amount that is 1.2 times the acid value of the colored resin particles (A)) of an epoxy group-containing long-chain alkyl compound (2-ethylhexyl glycidyl ether) (manufactured by TOKYO CHEMICAL INDUSTRY CO., LTD.) was used instead of 8.40 parts by mass of the epoxy-modified silicone oil compound ((3-glycidoxypropyl)bis(trimethylsiloxy)methylsilane) (manufactured by TOKYO CHEMICAL INDUSTRY CO., LTD.). The average particle diameter of this liquid developer (3) was 2.0 μm, and the relative standard deviation (CV value) of the particle diameters was 35%. Also, as a result of conducting a test in which this dispersion liquid was stored for 20 days, the average particle diameter was 1.3 μm, aggregation of particles did not arise and excellent storage stability was exhibited.

Example 4

A liquid developer (4) was obtained in the same manner as in Example 2 except that the unsaturated group-containing silicone compound (Y) obtained in Synthesis Example III-4 was used instead of the unsaturated group-containing silicone compound (X) obtained in Synthesis Example III-3. The average particle diameter of this liquid developer (4) was 1.9 μm, and the relative standard deviation (CV value) of the particle diameters was 29%. Also, as a result of conducting a test in which this dispersion liquid was stored for 20 days, the average particle diameter was 2.0 μm, aggregation of particles did not arise and excellent storage stability was exhibited.

Example 5

Into a 500 mL beaker, 20 parts by mass of the colored resin particles (D) having the carboxyl group at the surfaces thereof, obtained in Synthesis Example I-3, 171.60 parts by mass of the unsaturated group-containing silicone compound (X) obtained in Synthesis Example III-3, and 5.25 parts by mass (which is an equivalent amount that is 1.0 time the acid value of the colored resin particles (B)) of an epoxy-modified silicone oil compound ((3-glycidoxypropyl)bis(trimethylsiloxy)methylsilane) (manufactured by TOKYO CHEMICAL INDUSTRY CO., LTD.) were poured, then a dispersion treatment was carried out for 2 hours using an ultrasonic dispersing machine (output: 130 W, frequency: 20 kHz, pulsar type), 10 parts by mass of 15% (by mass) zirconium octylate (manufactured by NIHON KAGAKU SANGYO CO., LTD.) was added, and a liquid developer (5) was thus obtained. The average particle diameter of this liquid developer (5) was 0.8 μm, and the relative standard deviation (CV value) of the particle diameters was 23%. Also, as a result of conducting a test in which this dispersion liquid was stored for 20 days, the average particle diameter thereof was 0.8 μm, aggregation of particles did not arise and excellent storage stability was exhibited.

Comparative Example 1

—Production of Liquid Developer using Non-curable Electrically Insulating Liquid—

Into a 500 mL beaker, 20 parts by mass of the colored resin particles (C) obtained in Comparative Synthesis Example II-1, and 180 parts by mass of a non-curable dimethylsiloxane (SH200, manufactured by Dow Corning Toray Co., Ltd.) (viscosity: 20 mPa·s) serving as an electrically insulating liquid were poured, then a dispersion treatment was carried out for 2 hours using an ultrasonic dispersing machine (output: 130 W, frequency: 20 kHz, pulsar type), 10 parts by mass of 15% (by mass) zirconium octylate (manufactured by NIHON KAGAKU SANGYO CO., LTD.) was added, and a liquid developer was thus obtained; here, due to dispersion failure, 5.0 parts by mass of a polyether-modified silicone oil (KF-945, manufactured by manufactured by Shin-Etsu Chemical Co., Ltd.) was further added, then an ultrasonic dispersion treatment was carried out again, and a liquid developer (6) was thus obtained. The average particle diameter of this liquid developer (6) was 2.5 μm, and the relative standard deviation (CV value) of the particle diameters was 280%. Also, as a result of conducting a test in which this dispersion liquid was stored for 20 days, aggregation of particles arose, and although redispersion was carried out, there was dispersion failure.

Comparative Example 2

A liquid developer (7) was obtained in the same manner as in Example 1 except that the unsaturated group-containing silicone compound (Z) obtained in Comparative Synthesis Example IV-1 was used instead of the unsaturated group-containing silicone compound (X) obtained in Synthesis Example III-3. The average particle diameter of this liquid developer (7) was 1.4 μm, and the relative standard deviation (CV value) of the particle diameters was 35%. Also, as a result of conducting a test in which this dispersion liquid was stored for 20 days, the average particle diameter thereof was 1.4 μm, aggregation of particles did not arise and excellent storage stability was exhibited.

The liquid developers obtained in Examples 1 to 5 and Comparative Examples 1 and 2 were evaluated.

Evaluation Test 1 (Output of Images by Electrophotographic Liquid Developing Device, Evaluation of Images after UV Curing and Evaluation of Fixability)

To 100 parts by mass of each of the liquid developers obtained in Examples 1, 2, 3, 4 and 5 and Comparative Example 2, 12.0 parts by mass of a photopolymerization initiator (IRGACURE 907, manufactured by Ciba Specialty Chemicals plc) was added, then images were developed and output by the image forming apparatus shown in FIG. 1, and subsequently UV irradiation was carried out using a high-pressure mercury lamp (wavelength: approximately 350 nm) with a lamp output of 120 W/cm. The resolving power of the images after the UV irradiation was visually evaluated, the background density was measured, and the fixability was visually evaluated.

Regarding Comparative Example 1, images were developed and output by the liquid developing device shown in FIG. 1, and subsequently the images were thermally fixed using a heating roller (surface temperature: 150° C.). The resolving power of the images was visually evaluated, the background density was measured, and the fixability of the images was visually evaluated. The evaluation results are shown together in Table 1.

TABLE 1

| | Resolving power (Background density) | Fixability |
|---|---|---|
| Example 1 (Developer 1) | A: favorable (0.04) | favorable |
| Example 2 (Developer 2) | A: favorable (0.05) | favorable |
| Example 3 (Developer 3) | A: favorable (0.10) | favorable |
| Example 4 (Developer 4) | A: favorable (0.04) | favorable |
| Example 5 (Developer 5) | A: favorable (0.04) | favorable |
| Comparative Example 1 (Developer 6) | B: unfavorable (0.35) | unfavorable fixation (thermal fixation) |
| Comparative Example 2 (Developer 7) | A: favorable (0.21) | unfavorable (Curing did not occur.) |

As is evident from the results shown in Table 1, the photocurable liquid developer including the polydimethylsiloxane having the vinyldimethyl group at both terminals, shown in relation to Comparative Example 2, did not enable liquid developer images to sufficiently cure at the time of fixation, which led to unfavorable fixability.

Meanwhile, the photocurable liquid developers of Examples according to the present invention were favorable in terms of both resolving power and fixability.

Next, an Example in which the photocurable liquid developer according to the present invention was applied to an inkjet image forming method will be explained.

Example 6

Into a 200 mL beaker, 10 parts by mass of MICROLITH BLUE 4G-WA (manufactured by Ciba Specialty Chemicals plc) as a treated colorant (colored resin particles (A)), 64.75 parts by mass of the unsaturated group-containing silicone compound (X) obtained in Synthesis Example III-3, and 9.70 parts by mass (which is an equivalent amount that is 1.0 time the acid value of the colored resin particles (A)) of an epoxy-modified silicone oil compound (MCR-E11, manufactured by AZmax. co) were poured, then a dispersion treatment was carried out for 2 hours using an ultrasonic dispersing machine (output: 130 W, frequency: 20 kHz, pulsar type), and a liquid developer (8) was thus obtained. The average particle diameter of this liquid developer (8) was 0.12 μm, and the relative standard deviation (CV value) of the particle diameters was 15%. Also, as a result of conducting a test in which this dispersion liquid was stored for 20 days, the average particle diameter thereof was 0.15 aggregation of particles did not arise and excellent storage stability was exhibited.

The liquid developer obtained in Example 6 was evaluated.

Evaluation Test 2 (Evaluation of Images obtained by Inkjet Liquid Developing Device, Evaluation of UV Curing and Fixability)

To 100 parts by mass of the liquid developer (8) obtained in Example 6, 6.0 parts by mass of a photopolymerization initiator (IRGACURE 907, manufactured by Ciba Specialty Chemicals plc) was added, and then images were formed by an inkjet printer (IPSIO GX5000, manufactured by Ricoh Company, Ltd.). The images thus formed were visually evaluated for the resolving power and measured for the background density. Further, UV irradiation was carried out using a high-pressure mercury lamp (wavelength: approximately 350 nm) with a lamp output of 120 W/cm. The fixability of the images after the UV irradiation was visually evaluated. As a result, the images exhibited favorable resolving power and favorable fixability (curability).

What is claimed is:

1. A photocurable liquid developer comprising:

colored resin particles; and an electrically insulating liquid that cures by light, wherein the electrically insulating liquid contains an unsaturated group-containing silicone compound represented by General Formula (1) below, General Formula (1)

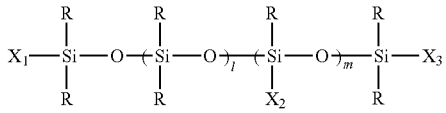

where R independently denotes a methyl group or a phenyl group, l and m each independently denote an integer of 0 to 100, and $X_1$, $X_2$ and $X_3$ each independently denote a C1-C6 alkyl group or Substituent A below, with at least one of $X_1$, $X_2$ and $X_3$ being Substituent A, Substituent A

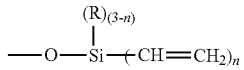

where R denotes a methyl group or a phenyl group, and n denotes an integer of 2 or 3.

2. The photocurable liquid developer according to claim 1, wherein the unsaturated group-containing silicone compound is a compound represented by General Formula (2) below, General Formula (2)

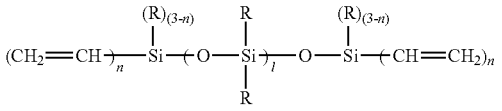

where R independently denotes a methyl group or a phenyl group, l denotes an integer of 0 to 100, and n denotes an integer of 2 or 3.

3. The photocurable liquid developer according to claim 1, further comprising a photopolymerization initiator.

4. The photocurable liquid developer according to claim 1, wherein the colored resin particles contain at least a binder resin and a colorant and have an acidic group at surfaces thereof, and wherein the colored resin particles are chemically modified with at least one of an epoxy group-modified silicone compound and an epoxy group-containing long-chain alkyl compound, as the epoxy group reacts with the acidic group.

* * * * *